US006880822B2

(12) United States Patent
Fukushima et al.

(10) Patent No.: US 6,880,822 B2
(45) Date of Patent: Apr. 19, 2005

(54) PAPER FEEDER, RECORDING APPARATUS, AND METHOD OF DETECTING A POSITION OF A TERMINAL EDGE OF A RECORDING MATERIAL IN THE RECORDING APPARATUS

(75) Inventors: Toru Fukushima, Nagano (JP); Kazuhisa Kawakami, Nagano (JP); Masafumi Furuyama, Nagano (JP); Yoji Sasai, Nagano (JP); Norihiro Yamashita, Nagano (JP); Yoichi Kobayashi, Nagano (JP); Hirotomo Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 10/228,258

(22) Filed: Aug. 27, 2002

(65) Prior Publication Data

US 2003/0057635 A1 Mar. 27, 2003

(30) Foreign Application Priority Data

Aug. 28, 2001 (JP) ..... P2001-257406
Aug. 30, 2001 (JP) ..... P2001-261998

(51) Int. Cl.[7] ..... B65H 1/26
(52) U.S. Cl. ..... 271/157; 271/160; 271/162
(58) Field of Search ..... 271/160, 162

(56) References Cited

U.S. PATENT DOCUMENTS 5,738,348 A 4/1998 Yasue et al.
5,893,556 A * 4/1999 Akahane et al. ..... 271/126
5,944,430 A 8/1999 Myung
6,095,703 A 8/2000 Takeda et al.
6,142,467 A 11/2000 Funada
6,330,424 B1 12/2001 Chapman et al.
6,354,586 B1 * 3/2002 Samoto ..... 271/127
2001/0019192 A1 9/2001 Yen et al.

FOREIGN PATENT DOCUMENTS

EP 0 478 300 A 4/1992

* cited by examiner

*Primary Examiner*—Donald P. Walsh
*Assistant Examiner*—Kaitlin Joerger
(74) *Attorney, Agent, or Firm*—Sughrue Mion, PLLC

(57) ABSTRACT

A paper feed unit includes a hopper on which sheets are stacked and which is turned around a rotation shaft. The hopper is turned to move apart from or move to a paper feed roller. The paper feed unit has three modes: a large release mode in which the hopper is turned to be most apart from the paper feed roller, a non-release mode in which the printing sheet is abutted against the paper feed roller, and a small release mode in which the printing sheet is slightly separated from the paper feed roller, and is at a medium level between the above two modes. When a paper feeding job is still present, a state that the uppermost printing sheet is slightly separated from the paper feed roller is retained by the small release mode, whereby a swing range of the hopper is minimized.

10 Claims, 28 Drawing Sheets

FIG. 29

| TRANSPORTING SPEED (ips) | | 12 | 10.5 | 9 | 7.5 | 6 | 4.5 | 3 | 1.5 |
|---|---|---|---|---|---|---|---|---|---|
| | | NOT LESS THAN 12ips | 12>V ≧10.5 | 10.5>V ≧9 | 9>V ≧7.5 | 7.5>V ≧6 | 6>V ≧4.5 | 4.5>V ≧3 | NOT MORE THAN 3ips |
| ENCODER PERIOD (μs) | | NOT MORE THAN 58μs | 58<T ≦66 | 66<T ≦72 | 72<T ≦93 | 93<T ≦116 | 116<T ≦154 | 154<T ≦231 | NOT LESS THAN 231μs |
| CORRECTION QUANTITY | DISTANCE (mm) | 2.9 | 2.6 | 2.2 | 1.8 | 1.5 | 1.1 | 0.7 | 0.4 |
| | NUMBER OF PULSES (1/1440dpi) | 186 | 167 | 141 | 116 | 96 | 71 | 45 | 26 |

PAPER FEEDER, RECORDING APPARATUS, AND METHOD OF DETECTING A POSITION OF A TERMINAL EDGE OF A RECORDING MATERIAL IN THE RECORDING APPARATUS

BACKGROUND OF THE INVENTION

1. Field of the Invention

The present invention relates to a paper feeder which stores a stack of recording materials, and feeds the recording materials sheet by sheet from the uppermost recording material to the downstream side, a recording apparatus for recording an image on a recording material, and a method of detecting a position of the terminal edge of a recording material.

2. Description of the Related Art

A printer is known as one form of the recording apparatus. Some of the printers are each equipped with a paper feeder for feeding the recording materials as printing sheets sheet by sheet from the uppermost recording material to a downstream side. The paper feeder includes a paper feed roller rotatably driven, and a hopper. The hopper is formed with a plate member long in the width direction of the printing sheet, and includes a fulcrum which is slanted when viewed from the side a sheet transport path of the printing sheet and is located in an upper part. When turned, it angularly moves toward the paper feed roller, and is pressed against the paper feed roller, or angularly moves apart from the paper feed roller. When printing sheets stacked in the hopper are moved upward by the hopper, the printing sheets are fed sheet by sheet from the uppermost printing sheet of the stack.

The hopper is urged by an urging device to turn in such a direction in which it is pressed against the paper feed roller. As a result, the stacked printing sheet is abutted on the paper feed roller. The hopper is provided with a release device, and is turned by the hopper release device in such a direction that it moves apart from the paper feed roller and its state is retained. The hopper is angularly moved between a sheet feeding position at which the uppermost printing sheet is abutted against the paper feed roller (paper feeding state) and a stand-by position at which it is most apart from the paper feed roller (release state). The sheet feeding position varies depending on the number of printing sheets as set (stacked).

When the hopper is moved from the stand-by position to the sheet feeding position, it is energetically turned to the paper feed roller or in a pressing-contact direction by the urging force of the urging device. With the turn, the printing sheet hits the paper feed roller, and a great sound (hitting sound) is generated from component parts around the hopper and the roller.

An angle (swing angle) developed when the hopper is moved from the stand-by position to the sheet feeding position, somewhat varies depending on the stack amount of the printing sheets as mentioned above. As the stack amount of the printing sheets is larger, the swing angle is smaller, and while the stack amount is smaller, the swing angle becomes larger. Accordingly, when the stack amount of the printing sheets is small where the swing angle is large, much time is taken for the sheet feeding operation, viz., high speed repeating sheet feeding operation cannot be performed.

An ink jet printer prints an image on a printing sheet in a manner that an operation of ejecting ink to the printing sheet while the recording head is reciprocated in the main scan direction and an operation of moving the printing sheet in the sub-scan direction are alternately repeated. The ink jet printer generally uses a sheet detector for detecting the printing sheet for the purpose of detecting a leading edge and a terminal edge of the printing sheet. Various types of sheet detectors for detecting the printing sheets are present. One of those known detectors is constructed such that when the printing sheet is fed, a rotatable lever part is projected and the printing sheet presses forward and turns the lever part to thereby detect the printing sheet.

There is known a sheet detector in which a mechanism having some movable part, not the rotatable lever part, engages with the printing sheet to thereby detect the printing sheet. This type of detector may take various forms. Any of those detectors detects the leading position of the printing sheet when the movable part of the sheet detector starts to engage with the recording sheet, and detects the terminal edge of the printing sheet when its engagement with the recording sheet ends.

The sheet detector of the type which detects the printing sheet through the engagement of the mechanism having the movable part engages with the printing sheet, has the following defect. At the instant that the terminal edge of the printing sheet leaves the movable part following the ending of the engagement of the movable part with the printing sheet, the sheet detector cannot recognize the leaving of the terminal edge. Exactly, a slight time elapses from the instant that the terminal edge of the printing sheet leaves the movable part till the movable part starts to move under its weight or urging force of the urging device as it returns to a fixed position and reaches a position at which the movable part can recognize the fact that the printing sheet does not engage with the movable part. That is, a slight time lag occurs.

If the sheet detector of the non-contact type, such as an optical sensor, is used, the time lag is almost negligible. On the other hand, in the case of the sheet detector which detects the printing sheet through the engagement of the movable part with the printing sheet, when it detects the terminal edge of the printing sheet, a fixed time lag occurs. The position of the terminal edge of the printing sheet, when detected, is shifted from its correct position by a distance that the printing sheet is transported during the delay time.

However, the detection offset of the terminal edge position of the printing sheet, which is caused by the delay time, is almost negligible since the transporting speed is relatively slow. It little affects the print quality.

In recent ink jet recording apparatuses, there is a tendency that the transporting of the printing sheet is performed at high speed in order to reduce the recording execution time. Accordingly, the detection offset of the terminal edge position of the printing sheet is not negligible. As a result, the following problems will be created: the blank part at the terminal edge of the printing sheet becomes narrow or the recording operation is continued beyond the terminal edge of the sheet.

The delay time may be reduced by narrowing the movable range of the movable part. If the movable range is too narrowed, the movable part will erroneously be moved responsive to a slight variation of the state of the printing sheet engaging the movable part, vibration and the like. In this respect, there is a limit in reducing the delay time by the narrowing the movable range of the movable part.

When the movable part is urged to a fixed position by an urging device having a strong urging force in order to increase the moving speed at which the movable part returns to the fixed position from the instant that the printing sheet leaves the movable part, the urging force is too strong. As a result, in the case of the printing sheet having a high rigidity, there is a danger that the leading edge of the printing sheet cannot move the movable part. For this reason, there is a limit in increasing the moving speed at which the movable part returns to the fixed position by urging the movable part to the fixed position by a strong urging force.

A possible solution to this problem is to uniquely correct the terminal edge position of the printing sheet based on the transporting speed of the printing sheet, which is set at the time of the recording control. However, the transporting speed of the printing sheet is not always constant since the transporting speed is repeatedly accelerated and decelerated by intermittently stopping the transporting of the printing sheet. For this reason, the terminal edge position of the printing sheet, which is uniquely computed from the transporting speed of the printing sheet that is set at the time of recording control, will be poor in precision.

SUMMARY OF THE INVENTION

Accordingly, an object of the present invention is to reduce noise generated when the hopper is turned, and to realize a high speed paper feeding operation.

Another object of the invention is to provide a recording apparatus equipped with a sheet detector for detecting a printing sheet through the entangling of a movable mechanism with the printing sheet, which the recording apparatus is free from such a disadvantage that the printing sheet is transported at high speed and a printing operation is performed, and then a position of the terminal edge of the printing sheet is shifted from its correct position.

To achieve the above objects, the invention provides a first paper feeder comprising:

- a paper feed roller for feeding a recording material to a downstream side of transportation by the paper feed roller;
- a hopper formed with a plate member long in a width direction of the recording material, the hopper being angularly moved around a fulcrum thereof so as to be apart from and to be abutted against the paper feed roller;
- an urging device located opposite to the paper feed roller with respect to the hopper for urging the hopper toward the paper feed roller from a backside of the hopper; and
- a hopper release device for moving the hopper apart from the paper feed roller while resisting the urging device;
- wherein a plurality of the recording materials are stacked in the hopper and are pushed upward so as to be successively fed to the downstream side of transportation from an uppermost recording material of the stacked recording materials; and
- the hopper release device has a non-release mode where the uppermost recording material is abutted against the paper feed roller by an urging force of the urging device,
- a small release mode where the hopper is turned and held so that the uppermost recording material is slightly separated from the paper feed roller, and
- a large release mode where the hopper is turned and held so that the hopper is at the most apart from the paper feed roller.

In the first paper feeder, a stand-by position (release state) of the hopper is controlled to be an appropriate position in accordance with an amount of stacked recording materials. As a result, the swing angle of the hopper is minimized, noise generated when the hopper is swung is reduced, and high speed paper feeding operation is ensured.

The hopper release device for separating the hopper from the paper feed roller has three modes: a non-release mode, a large release mode, and a small release mode, which is at a medium level between the former modes.

In the non-release mode, the hopper release device does not impart any external force to the hopper, and the recording material is abutted against the paper feed roller by only the urging force of the urging device. In this mode, the hopper is at a sheet feeding position (sheet feeding state).

In the large release mode, the hopper is turned so that the hopper is most apart from the paper feed roller, and retains its state. In his mode, the hopper is at a perfect sand-by position (release state), and in this state, the user may set recording materials on the hopper.

The first paper feeder has the small release mode, which is at a medium level between the non-release mode and the large release mode. In the small release mode, the hopper is turned so that the uppermost recording material is slightly separated from the paper feed roller, and its state is retained. Accordingly, when the hopper is turned from this state to feed a second or next recording material, an angle (swing angle) of the hopper developed when the recording material is abutted against the paper feed roller is minimized. For example, when the next paper feeding job arrives, the small release mode is executed. If so done, the noise generated when the recording material is abutted against the paper feed roller is reduced, and high speed paper feeding (repetitive paper feeding) is possible.

A second paper feeder of the invention, which depends from the first paper feeder, is provided. In the second paper feeder, the hopper release device is brought in the small release mode during a period between an end of feeding the uppermost recording material and a start of feeding the successive recording material.

In the second paper feeder, during a period of time from the end of feeding the uppermost recording material till the feeding of a second recording material starts, the hopper release device retains a state that the second recording material is slightly separated from the paper feed roller, by the small release mode. Therefore, the swing angle is minimized as described above, and the noise generated when the hopper is swung is reduce, and high speed paper feeding operation is ensured.

A third paper feeder, which depends from the first or second paper feeder, is provided. In the third paper feeder, the hopper release device is brought in the large release mode after an end of feeding a final recording material.

In this paper feeder, after execution of a series of paper feeding jobs ends, the hopper release device retains a state that the hopper is most apart from the paper feed roller, by the large release mode. Even when the user sets additional recording materials on the hopper after execution of a series of paper feeding jobs ends, there is no need of user's operation to manually press down the hopper. In this respect, the recording material setting work is easy.

A fourth paper feeder, which depends from any of the first to third paper feeders, is provided. In the fourth paper feeder, the hopper release device including

- a rotary cam,
- a cam lever engaging with the rotary cam and displacing in a radial direction of the rotary cam when the rotary cam rotates, and
- a cam lever holder axially supporting the cam lever so as to be swingable in an axial direction of the rotary cam, and having a hopper acting part through which a rotational force for the hopper is imparted, whereby the cam lever holder swings around a rotation shaft parallel to the axial direction of the rotary cam to thereby angularly move the hopper when the cam lever displaces in the radial direction of the rotary cam, the rotary cam being provided with a stepped cam part provided with a plurality of fan-shaped cams which are disposed in a stepped manner from an outer periphery of the rotary cam to a center of rotation thereof, an outer peripheral surface of each of the fan-shaped cams forming a cam face and being engageable with the cam lever, a non-cam part for displacing the cam lever to an inner periphery side of the rotary cam till the uppermost recording material is abutted against the paper feed roller, and a cam lever guide for guiding the cam lever to one of the cam faces of the fan-shaped cams which is located on an outer periphery side of the rotary cam and is the closest to a position of the cam lever in which the uppermost recording material is in pressing contact with the paper feed roller, wherein the hopper release device is brought into the large release mode when the cam lever is engaged with the cam face of the outermost fan-shaped cam, the hopper release device is brought into the non-release mode when the cam lever is engaged with the non-cam part or the cam lever guide part, and the hopper release device is brought into the small release mode when the cam lever is guided to one of the cam faces of the fan-shaped cams by the cam lever guide.

In the fourth paper feeder, any of the three modes, non-release mode, large release mode and small release mode, may be selected by rotating the rotary cam without using a complicated drive force mechanism.

A fifth paper feeder, which depends from the fourth paper feeder, is provided in which the rotary cam is integrally formed with a resin.

In the case that the rotary cam is integrally formed with a resin, cost to manufacture the rotary cam is reduced.

A sixth paper feeder, which depends from the fourth paper feeder, is provided in which the rotary cam engages with a rotation shaft of the paper feed roller by a gear device, and rotates in accordance with a rotation of the paper feed roller.

In this paper feeder, the rotary cam engages with a rotation shaft of the paper feed roller by a gear device, and rotates in accordance with rotation of the paper feed roller. Accordingly, there is no need of using a drive source provided exclusively for the rotary cam, leading to cost reduction.

A seventh paper feeder, which depends from any of first to sixth paper feeders, is provided in which an action point at which the urging device imparts a force to the hopper and an action point at which the hopper release device imparts a force to the hopper are located at substantially the same position as viewed from the front of the hopper.

In the seventh paper feeder, little bending moment is generated in the hopper. Deformation of the hopper is prevented, and hence, a normal sheet feeding operation is maintained. The hopper consists of a plate member long in the width direction of the recording material. Its lower part is turned around a fulcrum provided at its upper part. Accordingly, it is easy to bend when it receives an external force. The paper feeder includes an urging device for turning the hopper in such a direction as to be pressed against the paper feed roller, and a release device for turning the hopper apart from the paper feed roller. In the seventh paper feeder, an action point at which the urging device imparts a force to the hopper and an action point at which the hopper release device imparts a force to the hopper are located at substantially the same position as viewed from the front of the hopper. With this feature, little bending moment is generated in the hopper. The bending of the hopper is prevented, and hence, a normal sheet feeding operation is maintained.

An eighth paper feeder, which depends from the seventh paper feeder, is provided in which the hopper release device includes a release bar having a first shaft part extending in the longitudinal direction of the hopper above the urging device, a second shaft part which extends vertically from one end of the first shaft part to the urging device and engages with an engaging part provided on the backside of the hopper, and a third shaft part extending from another end of the first shaft part substantially parallel to the second shaft part, and a bearing part for axially supporting the first shaft part, wherein the release lever is turned around the first shaft part to separate the hopper from the paper feed roller.

In this paper feeder, the hopper release device includes a release bar, shaped like U in plan view, which engages with the backside of the hopper. By turning the release bar, the hopper is turned in such a direction as to be apart from the paper feed roller. Accordingly, a space on the backside of the hopper is minimized.

A recording apparatus for recording an image on a recording material is provided with any of the first to eighth paper feeders.

Since the recording apparatus for recording an image on a recording material is provided with any of the first to eighth paper feeders, the recording apparatus has operation and effects similar to those of any of the first to eighth paper feeders.

According to another aspect of the invention, there is provided a first terminal edge position detecting method for detecting a terminal edge position of a recording sheet in a recording apparatus for recording an image on a recording sheet while the recording sheet is transported in a fixed direction at a predetermined transportation quantity, comprising the steps of:

detecting a passage of the terminal edge of the recording sheet and obtaining a detected position of the terminal edge of the recording sheet by a sheet detector which detects the recording sheet by contacting therewith;

acquiring a transporting speed of the recording sheet at a time point of the passage of the terminal edge of the recording sheet;

computing a detect delay error transportation quantity of the recording sheet which is performed in the fixed direction during a detect delay time defined between an instant that the terminal edge of the recording sheet leaves the sheet detector and an instant that the sheet detector detects the passage of the terminal edge of the recording sheet; and computing the terminal edge position of the recording sheet by correcting the detected position of the terminal edge the detected by the sheet detector with the detect delay error transportation quantity.

Thus, in the sheet detector for detecting the recording sheet in a state that the sheet detector is in contact with the recording sheet, a detect delay error transportation quantity of transportation of the recording sheet which is performed during a detect delay time of detecting the terminal edge of the recording sheet is computed from a transporting speed of the recording sheet at a time point that the sheet detector detects passage of the terminal edge of the recording sheet, and a position of the terminal edge of the detected by the sheet detector is corrected using the detect delay error transportation quantity computed. Accordingly, a detect offset of the terminal edge position of the recording material by the detect delay time is greatly reduced.

As described above, the transporting speed of the printing sheet is not always constant since the transporting speed is repeatedly and intermittently transported and stopped. Therefore, to make an exact correction of the terminal edge position of the recording material, the detect delay error transportation quantity of transportation of the recording sheet must be computed from a transporting speed of the recording sheet at a time point that the sheet detector detects passage of the terminal edge of the recording sheet. By so doing, an exact correction of the terminal edge position of the recording material is secured.

Accordingly, according to the first terminal edge position detecting method, in the sheet detector which detects the recording material through the entangling of a movable mechanism with the printing sheet, there is successfully eliminated such a disadvantage that the printing sheet is transported at high speed and a printing operation is performed, and then a position of the terminal edge of the printing sheet is shifted from its correct position, and as a result, the print quality is deteriorated.

In a second terminal edge position detecting method, which depends from the first terminal edge position detecting method, the detect delay error transportation quantity is given by the following equation $$y=kx$$

where x: transporting speed of the recording sheet at a time point that the sheet detector detects the passage of the terminal edge of the recording sheet, y: detect delay error transportation quantity k: delay coefficient.

The detect delay error transportation quantity is a quantity of transportation of the recording material which is performed during the delay time, as described above. Therefore, it is larger as the transporting speed of the recording material at a time point that the sheet detector detects passage of the terminal edge of the recording sheet is higher. It increases proportional to the transporting speed of the recording material. Accordingly, the detect delay error transportation quantity can be obtained by multiplying the transporting speed by a fixed delay coefficient. The delay coefficient "k" varies depending on a detecting characteristic of the sheet detector and a relation between the position at which the sheet detector is disposed and the sheet transport path. The delay coefficient is a known value determined every specification of the recording apparatus.

Thus, the second terminal edge position detecting method has the effects similar to those of the first terminal edge position detecting method. Further, a transporting speed at a time point that the sheet detector detects passage of the terminal edge of the recording material is multiplied by the fixed delay coefficient "k", whereby the detect delay error transportation quantity is automatically computed.

A third terminal edge position detecting method, which depends from the first or second terminal edge position detecting method, is provided in which the transporting speed of the recording sheet at the time of the passage of the terminal edge is computed from an encoder signal output from an encoder device which detects a rotational displacement quantity of a transport drive roller for transporting the recording sheet.

Thus, a transporting speed of the recording sheet is computed from an encoder signal output from an encoder device. Therefore, a transporting speed of the recording sheet is exactly computed from an encoder signal output from a high performance encoder device.

The third terminal edge position detecting method has the effects similar to those of the first and second terminal edge position detecting methods. Further, since a transporting speed of the recording sheet is exactly computed from an encoder signal output from a encoder device, the terminal edge position of the terminal edge of the recording material is accurately corrected which is based on the detect delay error transportation quantity computed from the transporting speed of the recording material.

According to yet another aspect, there is provided a first recording apparatus comprising:

a record executing device for recording an image on a recording sheet while transporting the recording sheet in a fixed direction at a predetermined transportation quantity;

a sheet detector for detecting the recording sheet by contacting therewith so as to obtain a detected position of the terminal edge of the recording sheet; and a control part for controlling the record executing device;

wherein the control part computes a detect delay error transportation quantity of the recording sheet which is performed during a detect delay time from an instant that the terminal edge of the recording sheet leaves the sheet detector and to an instant that the sheet detector detects a passage of the terminal edge of the recording sheet, with a transporting speed of the recording sheet at the passage of the terminal edge of the recording sheet detected by the sheet detector, and the control part computes the terminal edge position of the recording sheet by correcting the detected position of the terminal edge of the recording sheet with the detect delay error transportation quantity.

The recording apparatus has the effects similar to those of the first terminal edge position detecting method.

A second recording apparatus depends from the first recording apparatus. In the second recording apparatus, the detect delay error transportation quantity is given by the following equation $$y=kx$$

where x: transporting speed of the recording sheet at a time point that the sheet detector detects the passage of the terminal edge of the recording sheet, y: detect delay error transportation quantity k: delay coefficient.

The second recording apparatus has the effects similar to those of the second terminal edge position detecting method.

A third recording apparatus is provided which depends from the first or second recording apparatus, and in this device, the record executing device includes a transport drive roller for transporting the recording sheet in the fixed direction by a rotational drive force, and an encoder device for detecting a rotational displacement position of the transport drive roller, and the control part computes a transporting speed of the recording sheet at a time point where the sheet detector detects the passage of the terminal edge of the recording sheet from an encoder signal output from the encoder device.

The third recording apparatus has the effects similar to those of the third terminal edge position detecting method.

A fourth recording apparatus depends from any of the first to third recording apparatuses, and in this recording apparatus, the sheet detector includes a lever which is granted with self-resetting habit for standing attitude, and pivotally supported to be rotatable in a state that the lever is protruded into a sheet transport path of the recording sheet, and the recording sheet is detected by a turning of the lever when a tip of the lever is pushed with the recording sheet.

The fourth recording apparatus, which is quipped with the sheet detector in which such a lever is pivotally supported to be rotatable in a state that the lever is protruded into a sheet transport path of the recording sheet, and when the lever is pushed with the recording sheet, the lever is turned and the recording sheet is detected, has also the effects similar to those of the first to fourth recording apparatuses.

As described above, the recording apparatus has three modes: a large release mode in which the hopper is most apart from the paper feed roller, and retains its state, a non-release mode in which the recording material is abutted against the paper feed roller, and a small release mode which is at a medium level between those two modes, and in which the recording material is slightly separated from the paper feed roller. The swing angle of the hopper may be minimized when an amount of stacked recording materials is small in a manner that the recording material is retracted from the paper feed roller by the small release mode, the large release mode, during a time period from the end of the paper feeding operation till the feeding of a second recording material starts. In other words, the retracting position of the hopper may be controlled to a position dependent on the amount of stacked recording materials. As a result, the swing angle of the hopper is minimized, noise generated when the hopper is swung is reduced, and high speed paper feeding operation is realized.

The present invention succeeds in providing a recording apparatus equipped with a sheet detector for detecting a printing sheet through the entangling of a movable mechanism with the printing sheet, which the recording apparatus is free from such a disadvantage that the printing sheet is transported at high speed and a printing operation is performed, and then a position of the terminal edge of the printing sheet is shifted from its correct position.

BRIEF DESCRIPTION OF THE DRAWINGS

The above and other objects, features and advantages of the present invention will become apparent from the following description of the presently preferred exemplary embodiments of the invention taken in conjunction with the accompanying drawings, in which:

FIG. 15A is a diagram showing a positional relation between the paper feed roller and the hopper, and FIG. 15B is a diagram showing an engagement state of the cam lever and the rotary cam;

FIG. 16A is a diagram showing a positional relation between the paper feed roller and the hopper, and FIG. 16B is a diagram showing an engagement state of the cam lever and the rotary cam;

FIG. 17A is a diagram showing a positional relation between the paper feed roller and the hopper, and FIG. 17B is a diagram showing an engagement state of the cam lever and the rotary cam;

FIG. 18A is a diagram showing a positional relation between the paper feed roller and the hopper, and FIG. 18B is a diagram showing an engagement state of the cam lever and the rotary cam;

FIG. 19A is a diagram showing a positional relation between the paper feed roller and the hopper, and FIG. 19B is a diagram showing an engagement state of the cam lever and the rotary cam;

FIG. 20A is a diagram showing a positional relation between the paper feed roller and the hopper, and FIG. 20B is a diagram showing an engagement state of the cam lever and the rotary cam;

FIG. 21A is a diagram showing a positional relation between the paper feed roller and the hopper, and FIG. 21B is a diagram showing an engagement state of the cam lever and the rotary cam;

FIG. 22A is a diagram showing a positional relation between the paper feed roller and the hopper, and FIG. 22B is a diagram showing an engagement state of the cam lever and the rotary cam;

FIG. 29 is a table showing a relationship among a transporting speed of a printing sheet at a time point where the sheet detector detects the terminal edge of the printing sheet, an encoder period detected by an encoder device, and a correction quantity of the terminal edge position of the printing sheet.

DESCRIPTION OF THE PREFERRED EMBODIMENTS

First Embodiment

A first embodiment of the present invention will be described with reference to the accompanying drawings. The description will be given in the order of "overall construction of the ink jet printer", "overall construction of the paper feeder" and "construction of hopper release device"

Overall Construction of Ink Jet Printer

Figure 1:
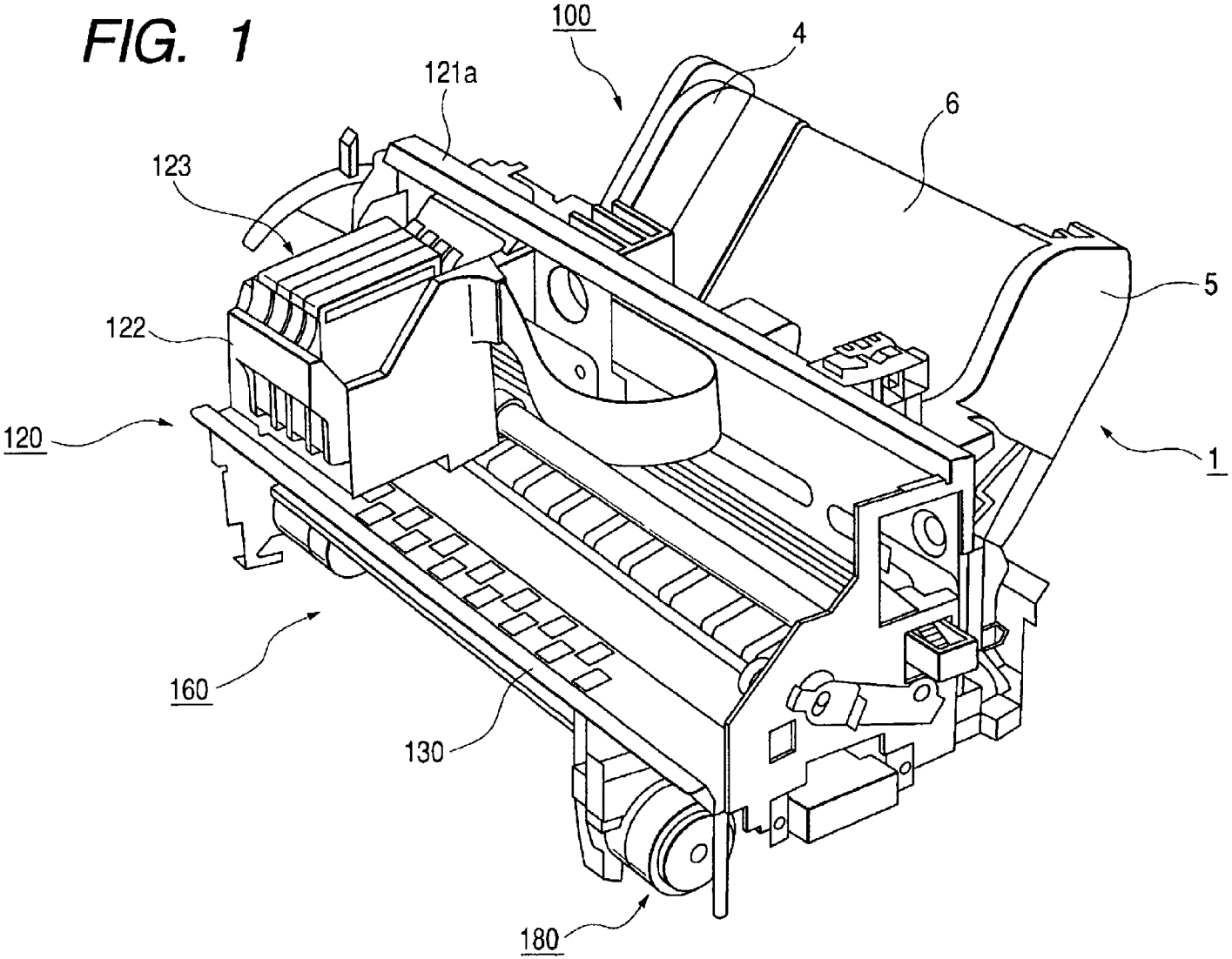
FIG. 1 is a perspective view showing an outward appearance of a main body of a first embodiment of an ink jet printer according to the present invention.
Figure 2:
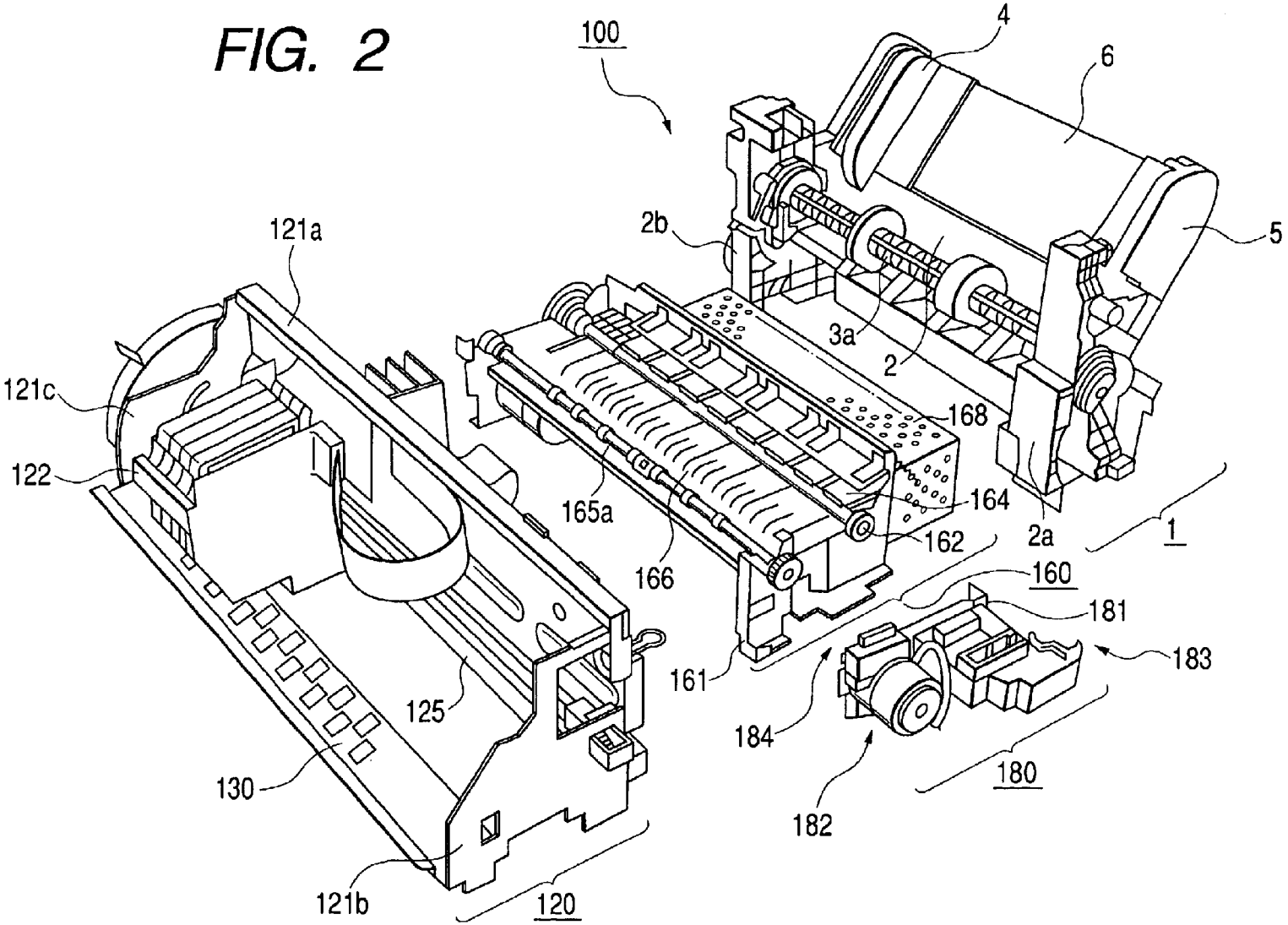
FIG. 2 is an exploded, perspective view showing the main body of the first embodiment of an ink jet printer according to the present invention.
Figure 3:
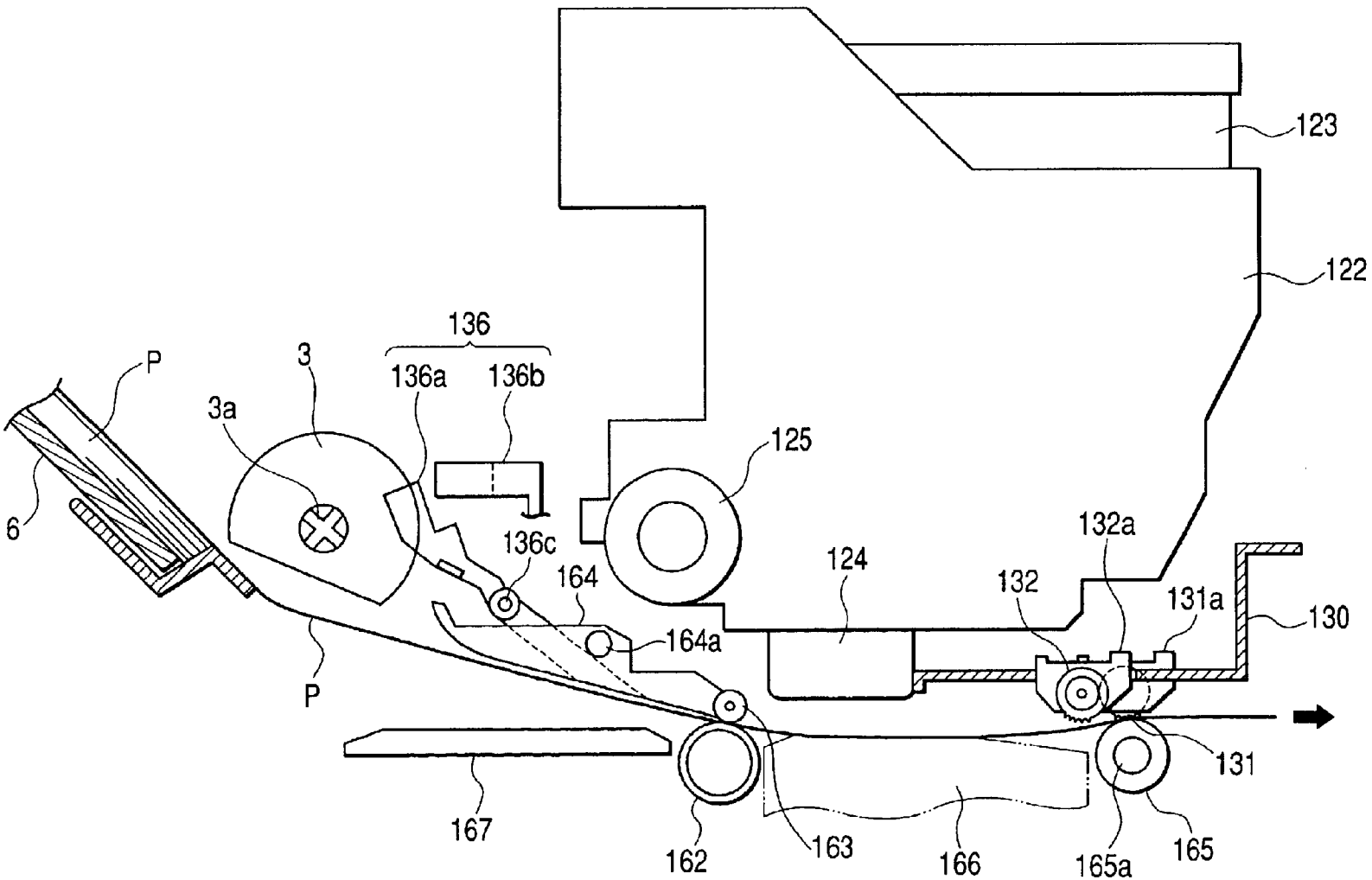
FIG. 3 is a sectional side elevation view showing the first embodiment of the present invention.
Figure 4:
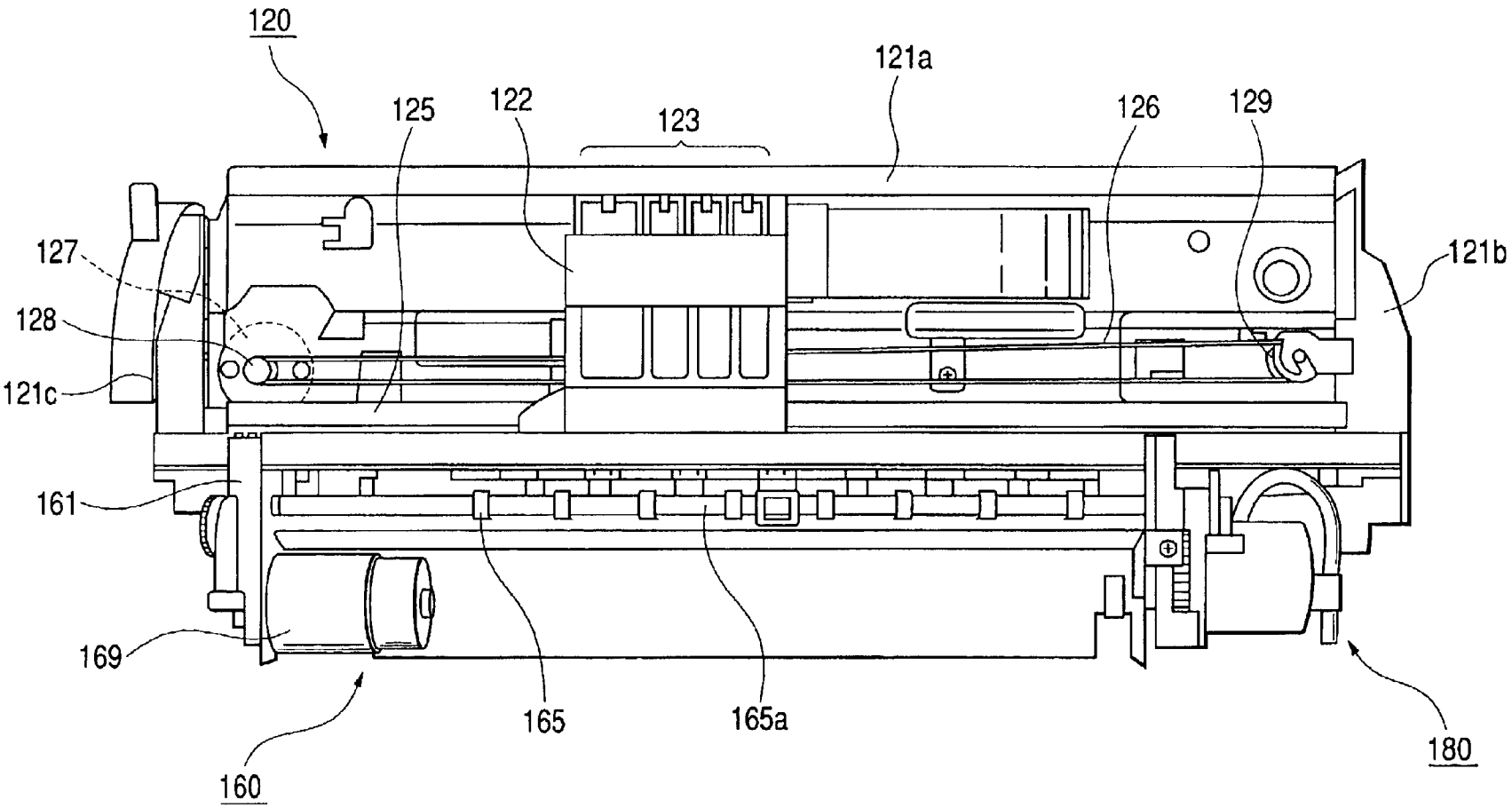
FIG. 4 is a front view showing the main body of the first embodiment of the ink jet printer according to the present invention.

An overall construction of an ink jet printer according to a first embodiment of the present invention will be described with reference to FIGS. 1 through 4. FIG. 1 is a perspective view showing an outward appearance of a main body of the ink jet printer (referred to as a printer". FIG. 2 is an exploded, perspective view showing the same. FIG. 3 is a sectional side elevation view showing the same. FIG. 4 is a front view showing the same.

Referring to FIGS. 1 and 2, a main body of a printer 100 is divided into a plurality of units. Those units are composed into the main body. In the figure, reference numeral 1 designates a paper feed unit as a sheet feeding device capable of feeding a printing sheet or paper sheet P (see FIG. 3) as a recording material or a rolled sheet (not shown). Reference numeral 120 designates a carriage unit 120 provided with a carriage having an ink jet recording head 124 (see FIG. 3). Reference numeral 160 designates a transport unit 160 for transporting a printing sheet P. Reference numeral 180 designates an ink system unit for doing maintenance to the ink jet recording head 124. The main body of the printer 100, as shown in FIG. 2, is divided into four units as shown in FIG. 2, and those four units are composed into the main body. In the present embodiment, a carriage unit 120 and an ink system unit 180 are coupled to the upper part and the right side part (the right side in FIG. 4) of the transport unit 160. The paper feed unit 1 is coupled to the rear side part of the carriage unit 120. As a result, the four units are composed into a single unit.

A sheet transporting path in the printer 100 will be described with reference to FIG. 3. In the description to be given hereunder, the left side (the rear side of the printer 100) in FIG. 3 will be "upstream side" of transportation, and the right side (the front side of the printer 100) in FIG. 3 will be referred to as "downstream side" of transportation. The printer 100 is equipped with the hopper 6. A stack of printing sheets P as cutform papers are put on the hopper 6, while being inclined. The hopper 6 is supported by a rotation shaft 6*a* (see FIG. 7) located in an upper part, and rotatable around the rotation shaft clockwise and counterclockwise. When the hopper is rotated, its lower part moves to a paper feed roller 3 and to be pressed against the same, and moves apart from the paper feed roller. The hopper 6 includes a movable guide 4, which is slidable in the width direction of the printing sheet P (see FIG. 1), and cooperates with a fixed guide 5 (see FIG. 1) to guide the side ends of the printing sheets P stacked. The uppermost sheet of the stacked printing sheets P is fed to the downstream side in a manner that the hopper 6 is pressed against the paper feed roller 3 and in a pressing state, the paper feed roller 3 is rotated. The paper feed roller 3 is shaped like D when viewed from side. In a print mode of the recording apparatus, a flat part of the paper feed roller is put to face the printing sheet P (its state of FIG. 3). This state of the paper feed roller prevents a transport load to be imparted on the printing sheet P from being generated.

A length of an arcuate part of the paper feed roller 3 is longer than such a length as to allow the tip of a printing sheet P fed from the hopper 6 to reach the nip point between a transport drive roller 162 and a transport follower roller 163, viz., a length of the sheet transport path ranging from an abutment point between the paper feed roller 3 and the printing sheet P to reach the nip point between a transport drive roller 162 and a transport follower roller 163. Accordingly, for example, when a number of printing sheets P are stacked on the hopper 6 in FIG. 3, the paper feed roller 3 must be moved to and located at an upper part (left upper part). In such a case, a variation of the sheet transport path, which results from the upward movement of the location of the paper feed roller 3, can be dealt with by increasing the diameter of the paper feed roller 3 (the roller diameter is 48 mm in the instant embodiment).

A sheet guide 167 as a plate member is substantially horizontally provided under a downstream part of the paper feed roller 3. The tip of a printing sheet P fed by the paper feed roller 3 comes in contact with the sheet guide 167 in an oblique direction, and smoothly guided to the downstream side. The transport drive roller 162 and the transport follower roller 163, which is brought into contact with ht transport drive roller 162, are provided downstream of the sheet guide 167. The printing sheet P is nipped between transport drive roller 162 and the transport follower roller 163, and transported downstream at a fixed pitch.

The transport follower roller 163 is supported by a shaft at a position downstream of a transport follower roller 164. The transport follower roller 164 is rotatable around a rotation shaft 164*a* clockwise or counterclockwise in FIG. 3. The transport follower roller 163 is constantly urged, by a twisted coiled spring (not shown), to a direction (clockwise in FIG. 3) in which the transport follower roller will come in pressing contact with the transport drive roller 162. A sheet detector 136 for detecting a passage of the printing sheet P is located near the transport follower roller 164 located closest to the 0 digit side (on this side in the right hand side part in FIG. 2). The sheet detector includes a sensor body 136*b* and a detector 136*a*. The detector 136*a* is shaped like V when viewed from side, and rotatable clockwise and counterclockwise in FIG. 2 around the center of a rotation shaft 136*c*, located at the central part in the figure. The sensor body 136*b* located above the detector 136*a* includes a light emitting part (not shown) and a light receiving part (not shown) for receiving light from the light emitting part. An upper part of the sensor body 136*b*, which is higher than the rotation shaft 136*c*, intercepts light going to the light receiving part and allows it to go to the light receiving part, when rotated. Accordingly, when with the passage of the printing sheet P, as shown in FIG. 3, the detector 136*a* is turned as is pushed upward, the upper part of the detector 136*a* separates from the sensor body 136*b*. In turn, the light receiving part is put in a light receiving state, and the sheet detector detects the passage of the printing sheet P.

Subsequently, a platen 166 and the ink jet recording head 124 are vertically and oppositely disposed downstream of the transport drive roller 162. The platen 166 is long in the main scan direction (see FIG. 2), and the printing sheet P, which is transported to below the ink jet recording head 124 with the rotation of the transport drive roller 162, is supported by the platen 166 from the under side. The ink jet recording head 124 is provided on the bottom part of a carriage 122, and the carriage 122 is reciprocated in the main scan direction, while being guided by a carriage guide 125. In the instant embodiment, an ink cartridge 123, as shown in FIG. 4, includes four cartridges respectively filled with four colors (black, yellow, cyan, magenta). Those cartridges may be replaced with other cartridges, independently.

A part downstream of the ink jet recording head 124 forms a sheet discharge part of the printer 100, and contains a sheet-discharge drive roller 165, a sheet-discharge follower roller 131, and an auxiliary sheet-discharge roller 132. A plurality of sheet-discharge drive rollers 165 are provided while being arranged in the axial direction of a sheet-discharge drive roller shaft 165*a*, which is rotatably driven (see FIG. 4). The sheet-discharge follower roller 131 is axially supported on a sheet-discharge roll holder 131*a* mounted on a sheet-discharge frame 130. The sheet-discharge follower roller 131 is rotated in follower manner in slight contact with the sheet-discharge drive roller 165. The printing sheet P having undergone the printing by the ink jet recording head 124 is discharged in a sheet discharge direction (arrow direction in FIG. 3) in a state that it is nipped between the sheet-discharge drive roller 165 and the sheet-discharge follower roller 131. The auxiliary sheet-discharge roller 132 axially supported on an auxiliary sheet-discharge roller holder 132*a* is provided somewhat upstream of the sheet-discharge follower roller 131, and prevents the printing sheet P from floating up from the platen 166 by pressing the printing sheet P somewhat downward, whereby a distance between the printing sheet P and the ink jet recording head 124 is controlled.

The hopper 6, movable guide 4, fixed guide 5 and paper feed roller 3 are contained in the paper feed unit 1 shown in FIGS. 1 and 2. A base of the paper feed unit 1 is constructed with a sheet feeding unit frame 2 having a column-like right mounting part 2*a* and a column-like left mounting part 2*b*, which stand erect on both sides of the hopper 6 as shown in FIG. 2. A paper feed roller shaft 3*a* serving as the rotation shaft of the hopper 6 and the paper feed roller 3, and the like are provided on the sheet feeding unit frame 2. The paper feed unit 1 is coupled to the rear side of the carriage unit 120 at the upper parts of the right mounting part 2*a* and the left mounting part 2*b*. The further detail of the paper feed unit 1 will be described later.

The sheet guide 167, transport drive roller 162, transport follower roller 164 and sheet-discharge drive roller shaft 165*a* are contained in the transport unit 160, as shown in FIGS. 1 and 2. A base of the transport unit 160, as shown in FIG. 2, is formed with a transport unit frame 161 shaped like U when viewed from top. The transport unit includes a power unit 168 as a power supply of the printer 100, which is located on the rear side of the transport unit. The transport unit further includes the sheet-discharge drive roller shaft 165*a* located on the front part thereof, and axially supports the transport drive roller 162 in the middle of the main body. The transport unit further includes the platen 166 located in the upper part of the front side, and the transport follower roller 164 in the middle thereof and at the upper part. Additionally, the transport unit 160 includes a drive motor 169 (see FIG. 4) at the lower part of the left side. The drive motor is used as a drive source used in common for the paper feed roller 3, transport drive roller 162, sheet-discharge drive roller 165, a pump device 182 to be described later, and a blade unit 184. The drive motor 169 and the five components to be driven by it are interconnected by a drive-force transmission mechanism of which the illustration and description are omitted, in a state that the four units are composed as shown in FIG. 1, and are selectively driven.

The ink system unit 180 as maintenance device of the ink jet recording head 124 is coupled to the right side part of the transport unit 160. The ink system unit 180, as shown in FIG. 2, includes a frame 181 as a base of the unit coupled to the right side surface of the transport unit frame 161. A cap device 183, pump device 182 and blade unit 184 are coupled to the frame 181. When the carriage 122 is moved to the home position (right side part in FIG. 4), the cap device 183 caps the ink jet recording head 124 to protect the nozzle surface (not shown). The pump device 182 supplies a negative pressure to the cap device 183 being in a capping state, and absorbs ink through nozzle orifices of the ink jet recording head 124. The blade unit 184 is movable between a position where it crosses the reciprocal movement region of the carriage 122 and a position where it retracts from the reciprocal movement region. The blade unit 184 moves to the position where it crosses the reciprocal movement region of the carriage 122, and the carriage 122 is moved from the printing region to the home position (the right side region in FIG. 4) or it is moved in the reverse direction, whereby it wipes out the nozzle surface (not shown) of the ink jet recording head 124 to thereby effect the cleaning operation.

The carriage guide 125 and the sheet detector 136 are provided in the carriage unit 120. Abase of the carriage unit 120, as shown in FIG. 2, is constructed with a main frame 121*a*, and a right side frame 121*b* and a left side frame 121*e* which stands erect on both sides of the main frame 121*a*. The carriage unit 120 axially supports the carriage guide 125 on the rear side part.

As shown in FIG. 4, the carriage unit 120 includes a carriage motor 127 on the left side surface thereof, and a drive pulley 128 is mounted on the carriage motor 127. A follower pulley 129 is provided on the right side of the carriage unit. A carriage belt 126 is set up between the drive pulley 128 and the follower pulley 129. A part of the carriage belt 126 is fixed to the carriage 122, and a part of the carriage belt 126 is fixed to the carriage 122. Accordingly, the carriage 122 is reciprocated in the main scan directions (right and left directions in FIG. 4) by the rotation of the carriage motor 127.

In FIG. 2, the sheet-discharge frame 130 is mounted on the carriage unit 120. The sheet-discharge frame 130 may be mounted on the carriage unit 120, and if necessary may be mounted on the transport unit 160. That is, it maybe contained in any of those units.

The main body of the printer 100 is thus constructed, and The four units are composed and coupled together, and the printer 100 is operable.

Detailed Configuration of Paper Feed Unit

Figure 5:
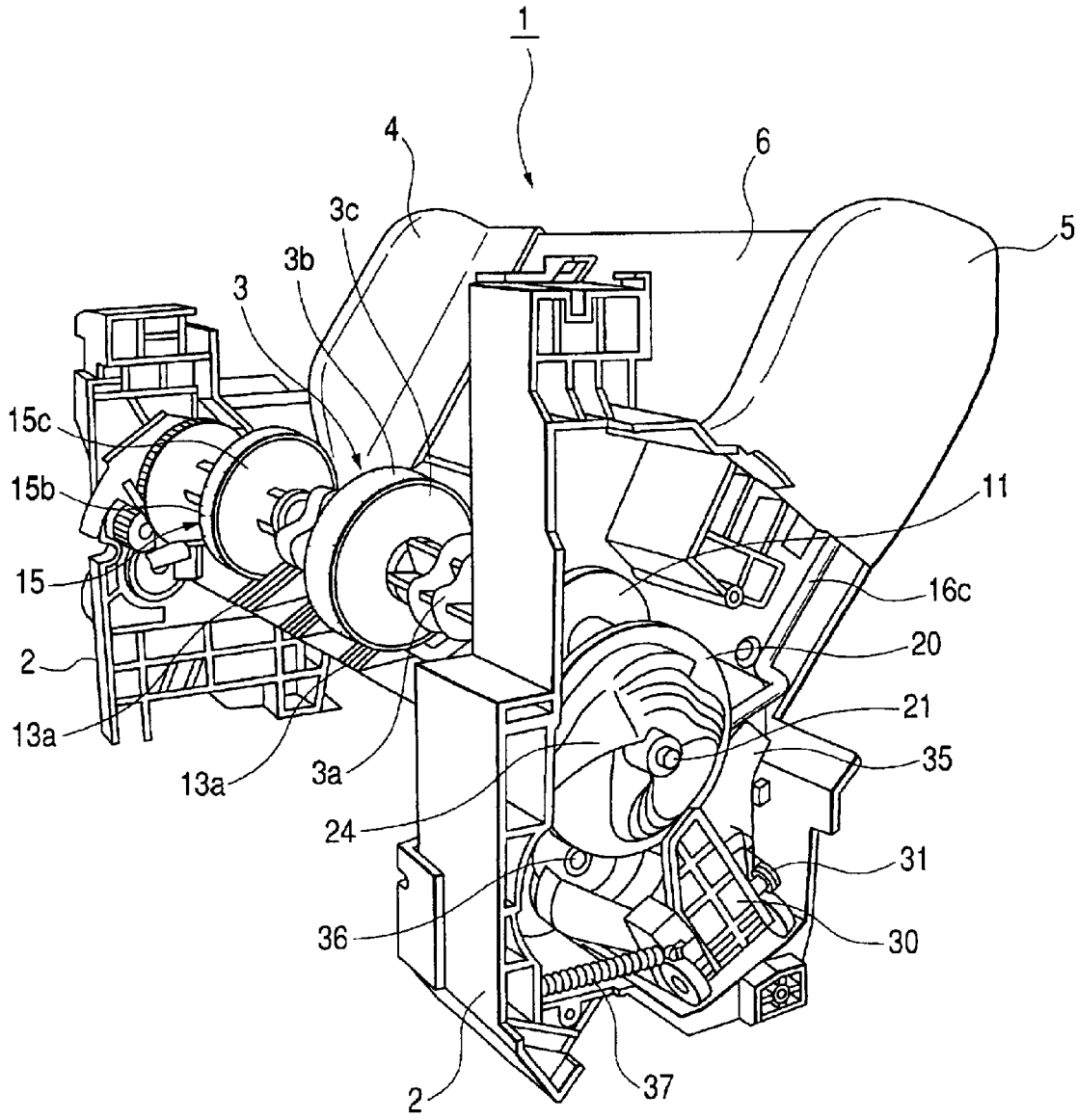
FIG. 5 is a perspective view showing a paper feeder constructed according to the present invention.
Figure 6:
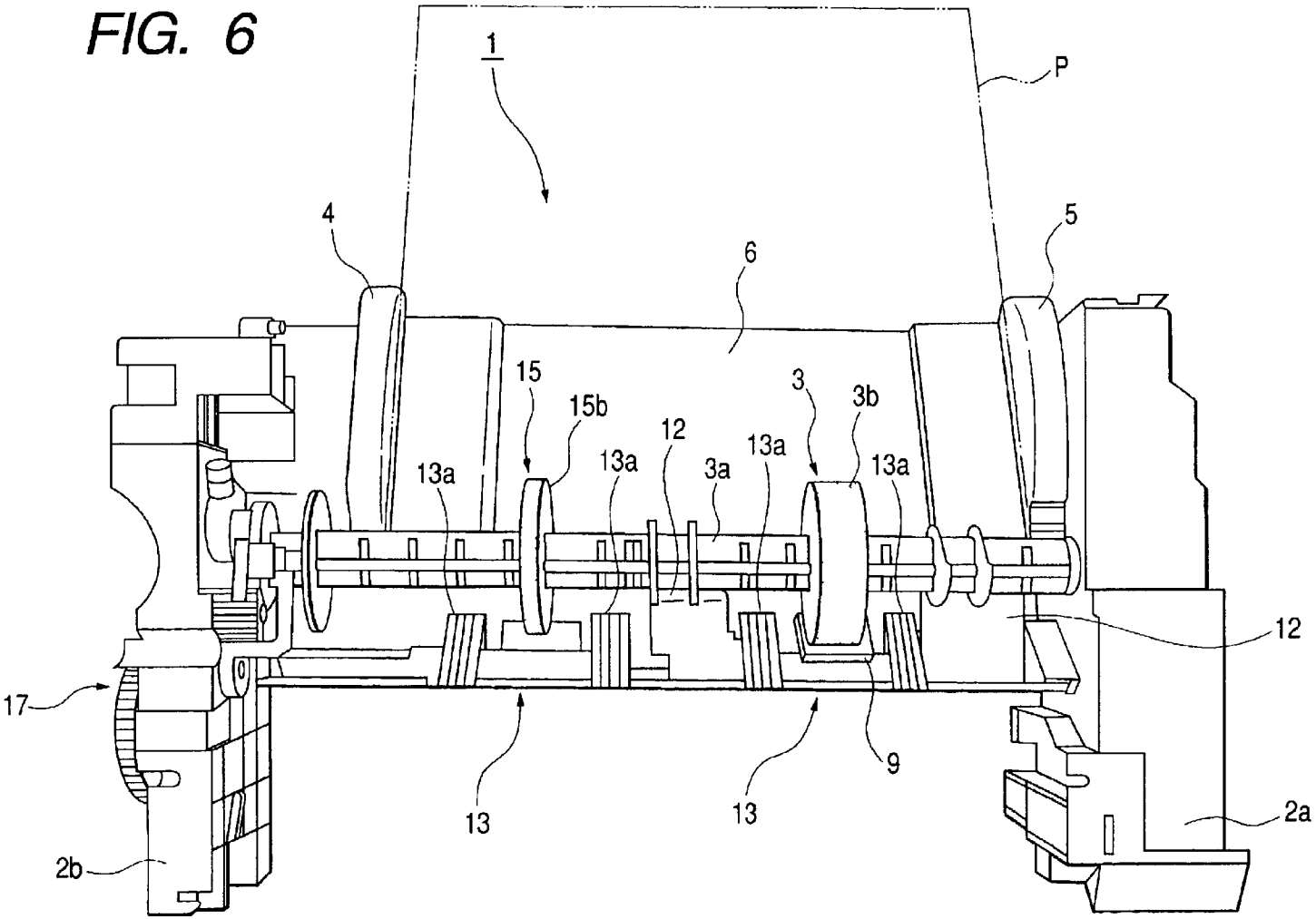
FIG. 6 is a front view showing the paper feeder of the invention.
Figure 7:
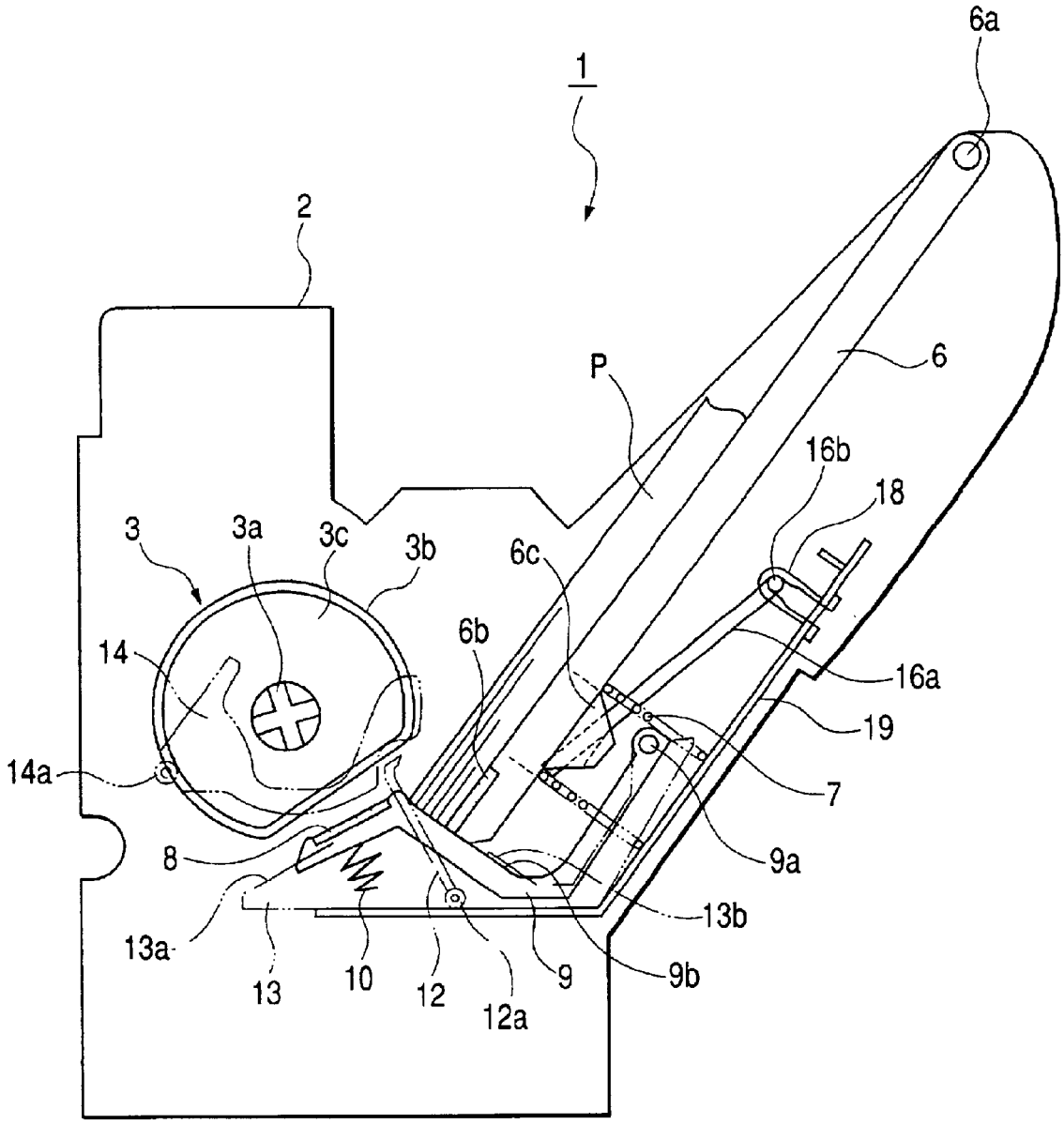
FIG. 7 is a sectional side elevation view showing the paper feeder of the invention.
Figure 8A:
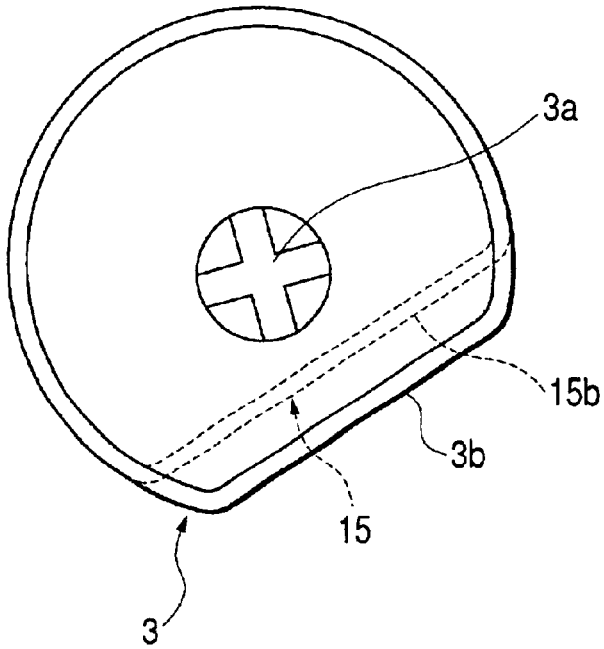
FIG. 8A is a side view showing a structure including a paper feed roller and a paper feed auxiliary roller.
Figure 8B:
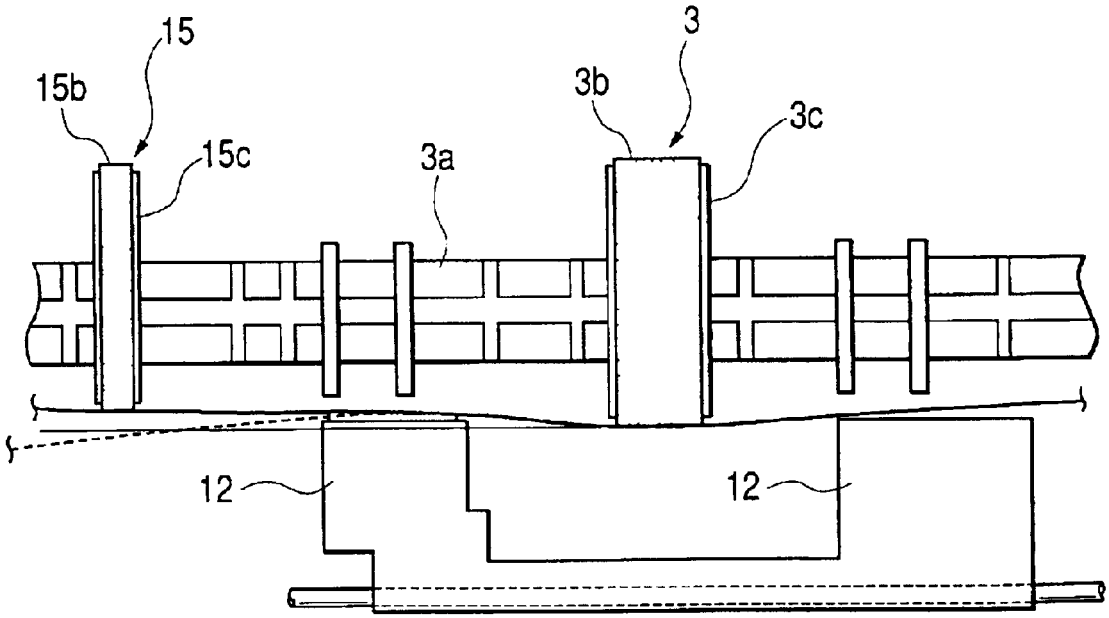
FIG. 8B is a front view showing the same.
Figure 9A:
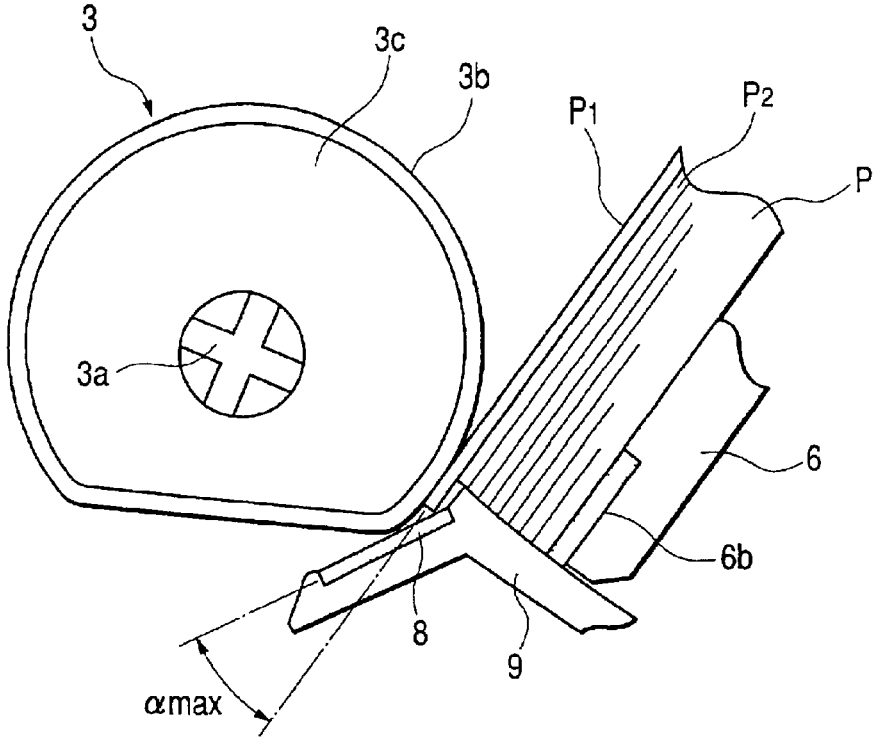
FIGS. 9A and 9B are explanatory diagrams for explaining a paper plug-in angle of a printing sheet P when it plugs in a separation pad 8 (partially enlarged view of FIG. 7)
Figure 9B:
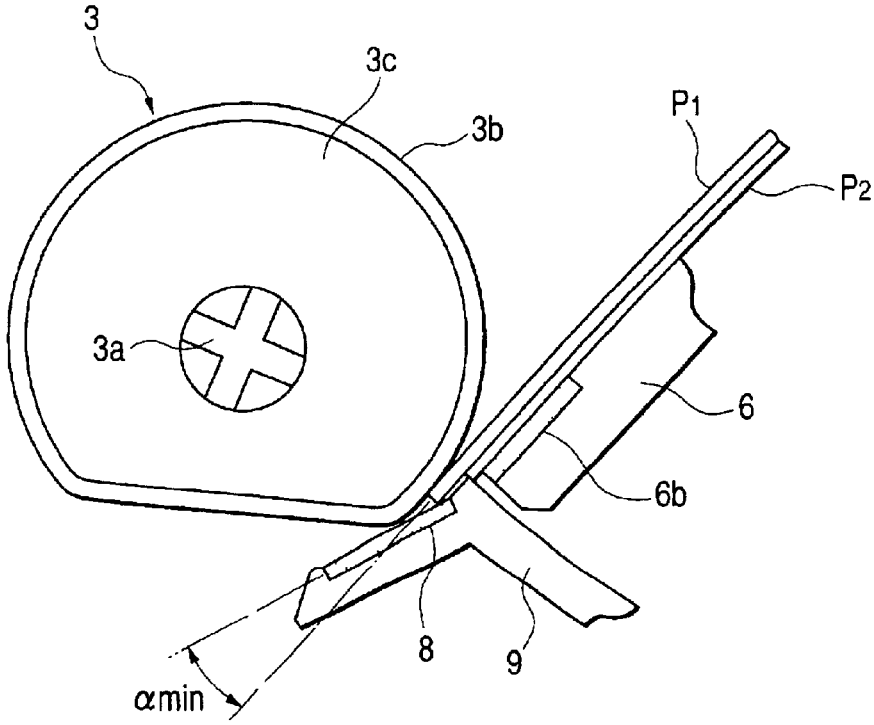

A detailed construction (overall construction) of the paper feed unit 1 will be described with reference to FIGS. 5 to 9B. FIG. 5 is a perspective view showing the paper feed unit 1; FIG. 6 is a front view of the same; FIG. 7 is a sectional side elevation view of the same; FIG. 8A is a side view showing a structure including a paper feed roller and a paper feed auxiliary roller, and FIG. 8B is a front view showing the same; and FIGS. 9A and 9B are explanatory diagrams for explaining a paper plug-in angle of a printing sheet P when it plugs in a separation pad 8 (partially enlarged view of FIG. 7).

Firstly, a base of the paper feed unit 1, as described above, is constructed with the sheet feeding unit frame 2. The paper feed unit includes a transmission gear device on the left side surface (left side in FIG. 6), and a hopper release device containing a rotary cam 20 and others on the right side surface (right side in FIG. 6). The paper feed roller shaft 3*a* is provided between them.

The transmission gear device 17 comes in mesh with a transmission gear (not shown) of the transport unit 160 in a state that the paper feed unit 1 is coupled to the carriage unit 120 (see FIG. 1). And it transmits a rotational force of the drive motor 169 (see FIG. 4) mounted on the transport unit 160 to the paper feed roller shaft 3*a*. Accordingly, the paper feed unit 1 (paper feed roller shaft 3*a*) uses its power source the drive motor 169, which serves as a drive source for the transport drive roller 162 and others. Accordingly, the paper feed unit does not use its own drive source, and in this respect, is reduced in cost to manufacture. And, the paper feed roller shaft 3*a* transmits a rotational force as imparted to its left side end by the transmission gear device 17 to a hopper releasing device (to be given later) provided on the right side end. Accordingly, in the present invention embodiment, the paper feed roller shaft 3*a* functions as the power transmission shaft as well as the rotation shaft of the paper feed roller 3.

The paper feed roller 3 that is driven and rotated by the paper feed roller shaft 3*a*, as shown in FIG. 6, is provided at the right end, viz., at a position deviated to the side located part from the transmission gear device 17. The paper feed roller 3 takes a shape like D when viewed from side, as described above. As shown in FIGS. 5 and 7, the paper feed roller includes a roller body 3*c* which is formed integrally with the paper feed roller shaft 3*a* by resin forming, and a rubber member 3*b* as an "elastic member" wound around the roller body 3*c*. With the presence of the rubber member 3*b*, a necessary friction coefficient of the paper feed roller to the printing sheet P is secured. As a result, the paper feed roller 3 is capable of reliably feeding the printing sheet P which is abutted on the paper feed roller per se without any slippage. In the present embodiment, EPDM (ethylene polypropylene rubber) is used for the rubber member 3*b*. A paper feed auxiliary roller 15, shaped like D when axially viewed, is provided on the paper feed roller shaft 3*a* while being located between the left side end of the paper feed roller shaft 3*a* and the paper feed roller 3. This will be described in detail later.

The hopper 6 as a plate member long in the width direction of the printing sheet P as described above is provided while being slanted as shown in FIG. 7. The hopper 6 is rotatable clockwise and counterclockwise in FIG. 7 around the rotation shaft 6*a* as described above. A compression coiled spring 7 as "urging device", which urges the lower part of the hopper 6 toward the paper feed roller 3, is provided at a lower part of the rear surface of the hopper. The compression coiled spring constantly urges the hopper 6 to turn in such a direction as to be pressed against the paper feed roller 3. The paper feed unit 1 is provided with "hopper release device", which urges the hopper 6 to move apart from the paper feed roller 3. The construction and operation of the hopper release device will be described in detail subsequently.

A separation pad holder 9 and a guide member 13 are provided under the hopper 6. The separation pad holder 9, as shown in FIG. 6, is disposed at a position facing the paper feed roller 3, and as shown in FIG. 7, holds a separation pad 8 formed with a friction member in a state that it faces the paper feed roller 3. The separation pad holder 9 is rotatable clockwise and counterclockwise in FIG. 7 around a rotation shaft 9*a*. And, it is urged to turn in a direction in which the separation pad 8 is brought into contact with the paper feed roller 3 by a compression coiled spring 10. Accordingly, when the paper feed roller 3 is turned from a state shown in FIG. 7 (the separation pad 8 is opposed to the flat part of the paper feed roller 3), the separation pad 8 is brought into pressing contact with the arcuate part of the paper feed roller 3.

The separation pad 8 that is provided on a separation pad holder 9 cooperates with the paper feed roller 3 to nip the uppermost printing sheet P comes in contact with the separation pad 8 at a contact (paper plug-in) angle $\alpha$, to thereby prevent the double feeding of a second printing sheet P and the subsequent ones. More exactly, materials of the rubber member 3*b* and the paper feed roller 3 are selected so as to satisfy a relation $\mu_1>\mu_2>\mu_3$ where $\mu_1$ is a friction coefficient between the paper feed roller 3 and the printing sheet P, $\mu_2$ is a friction coefficient between the printing sheets P, and $\mu_3$ is a friction coefficient between the printing sheet P and the separation pad. By selecting the friction coefficients so, the uppermost printing sheet P to be fed is reliably fed downstream with rotation of the paper feed roller 3, while a second printing sheet P and the subsequent ones stays at the separation pad 8. As a result, the double feeding of a second printing sheet P and the subsequent ones is prevented. In a lower part of the hopper 6, a holding pad 6*b* is provided at a position opposed to the paper feed roller 3 and a holding pad 6*b*. The holding pad 6*b* prevents a stack of printing sheets P on the hopper 6 from moving downstream when the uppermost printing sheet P is fed.

A variation range of a contact angle $\alpha$ in the embodiment, viz., a disposing position of the rotation shaft 6*a* which determines a swing angle of the hopper 6 and a dimension of the hopper 6 in the feeding direction (a longitudinal size of the printing sheet P) are selected as below. An angle developed when the hopper 6 swings from a state that it is most apart from the paper feed roller 3 to a state that the uppermost printing sheet P is abutted on the paper feed roller 3, varies depending on an amount of the printing sheets P stacked on the hopper 6. As a result, a contact angle $\alpha$ at which the tip of he printing sheet P comes in contact with the separation pad 8, also varies. FIG. 9A shows a contact angle $\alpha_{max}$ when a maximum number of printing sheets P set on the hopper, and FIG. 9B shows a contact angle $\alpha_{min}$ when an approximately minimum number of printing sheets P set on the hopper. As seen from the figure, as the number of printing sheets P as set is larger, the contact angle $\alpha$ becomes larger. In FIGS. 9A and 9B, character P1 designates the uppermost printing sheet, and P2, a second printing sheet subsequent to the uppermost printing sheet P1.

When in FIG. 9A, the contact angle $\alpha_{max}$ is larger than a maximum value $\alpha_1$ of the contact angle allowing the uppermost printing sheet P1 to pass therethrough, the uppermost printing sheet P1 to be fed is caught by the separation pad 8 and there is a chance that it is not fed. Conversely, when the contact angle $\alpha_{min}$ is smaller than a minimum value of the contact angle capable of preventing the double feeding of the printing sheet P, the second printing sheet P2 (a plurality of printing sheets P including the second printing sheet P2 and the subsequent ones) is nipped between the uppermost printing sheet P1 to be fed and the separation pad 8, possibly causing the double feeding of the printing sheets. In the embodiment, the position at which the rotation shaft 6*a* of the hopper 6 is disposed and the size of the hopper 6 in the paper feeding direction are selected so as to satisfy a relation of $\alpha_2 \leqq \alpha \leqq \alpha_1$ irrespective of the number of printing sheets P stacked on the hopper 6. Accordingly, the hopper is capable of always feeding the sheets since the contact angle $\alpha_{max}$ does not exceed the upper limit $\alpha_1$, and the $\alpha_{min}$ does not fall below the lower limit $\alpha_2$. In the embodiment, the length of the hopper 6 in the paper feeding direction is about 130 mm, and the swing angle of the hopper 6 is 10°. This swing angle does not contain a swing angle 2° of the hopper 6, which is developed till a maximum number of printing sheets P are set in the hopper, and the uppermost printing sheet P is abutted on the paper feed roller 3.

The guide members 13 will now be described. As shown in FIG. 6, two guide members 13 are disposed while being spaced from each other in the width direction of the printing sheet P, by a predetermined distance. One guide member 13 includes two smooth guide surfaces 13*a* (see FIG. 7) for guiding the printing sheet P downstream, which are separated in the width direction printing sheet P by a predetermined distance. The guide member 13 includes a contact surface 13*b* which is connected to the guide surfaces 13*a* and onto which the tips of the n obliquely stacked printing sheets P are substantially vertically abutted (see FIG. 7). The contact surface 13*b* consists of an arcuate surface (curved surface) which is configured around the rotation shaft 6*a* of the hopper 6. The tips of the printing sheets P obliquely stacked on the hopper 6 slide on and along the contact surface 13*b* with rotation of the hopper 6.

If a friction coefficient between the contact surface 13*b* and the tip of the printing sheet P is large, some time is consumed to complete an abutting operation to turn the hopper 6 and to abut the uppermost printing sheet P against the paper feed roller 3. This adversely affects the paper feeding operation, frequently. In this respect, it is desirable that the friction coefficient is as small as possible (for example, $\mu$<0.3). In the instant embodiment, the guide member 13 is formed by using POM (polyoxymethylene) or AES (acrylonitrile ethylene styrene). The contact surface 13*b* is coated with lubricant to reduce its friction coefficient. The separation pad holder 9 includes a similar contact surface 9*b*.

As shown in FIGS. 5 and 6, the paper feed auxiliary roller 15 is disposed between the paper feed roller 3 and the transmission gear device 17. The paper feed auxiliary roller 15 is shaped like D when viewed in the axial direction of the paper feed roller shaft 3*a*, as described above. The paper feed auxiliary roller 15, like the paper feed roller 3, includes a roller body 15*c* which is formed integrally with the paper feed roller shaft 3*a* by resin forming, and a rubber member 15*b* as an "elastic member" wound around the roller body 15*c*. Use of the rubber member 15*b* prevents a printing surface of the printing sheet P from being damaged.

The paper feed auxiliary roller 15 thus constructed has the following two functions in the paper feed unit 1 of the embodiment.

A first function of the paper feed auxiliary roller is to control an attitude of the printing sheet P when it is fed. The paper feed roller 3 and the separation pad 8 are provided in pair. In the light of cost reduction demand, it is desirable to provide only one pair of paper feed roller 3 and separation pad 8 as in the instance embodiment. However, to deal with printing sheets P of various sizes, in particular the printing sheet P of small size, the paper feed roller 3 and the separation pad 8 are located deviated to the 0 digit side (the right side in FIG. 6).

As shown in FIG. 3, in the paper feed unit 1, the printing sheet P is fed by the paper feed roller 3 in a state that the printing sheet P is curved downward. If the paper feed roller 3 is located deviated to the 0 digit side, the printing sheet P is not uniformly curved in the width direction. The side of the printing sheet on which the paper feed roller 3 is not disposed is less curved than the side of the printing sheet on which the paper feed roller 3 is disposed. In this state, advancing distances of the printing sheet P are different on the right and left sides of the tip of the printing sheet P, and a called skew possibly occurs. To cope with this, the paper feed auxiliary roller 15 is provided on the side of the printing sheet on which the paper feed roller 3 is not disposed, whereby the curving attitude of the printing sheet P is controlled to be uniform, and hence a normal paper feeding operation is secured.

The paper feed auxiliary roller 15 is shaped like D when viewed from side, like the paper feed roller 3. A diameter of the paper feed auxiliary roller is equal to that of the paper feed roller 3. In the paper feed auxiliary roller, a flat part of the D shape is more cut than that in the paper feed roller 3. This is best illustrated in FIG. 8A. As shown, the flat part of the paper feed auxiliary roller 15 is closer to the center of the rotation (viz., to the paper feed roller shaft 3*a*) than that of the paper feed roller 3 (the diameter of the paper feedroller 3 is 48 mm, and that of the paper feed auxiliary roller 15 is 4 mm).

The reason for this will be described below. When the printing sheet P is transported (in a print mode), the flat part of the paper feed roller 3 (and paper feed auxiliary roller 15) is opposed to the printing sheet P as shown in FIG. 7 in order to lessen a sheet transport load (a rotation load of the transport drive roller 162 (see FIG. 3). A sheet return lever 12 is disposed under the paper feed roller 3 as shown in FIG. 8B (see also FIG. 7). The printing sheet P, as shown in FIG. 8B, is slightly bent when viewed in the width direction by the paper feed roller 3 and the sheet return lever 12. In this case, if a configuration of the paper feed auxiliary roller 15 is the same as of the paper feed roller 3, the printing sheet P is outward curved as indicated by a broken line in FIG. 8B. As a result, the sheet transport load disadvantageously increases by a rigidity of the printing sheet P and the friction associated with the paper feed roller 3, paper feed auxiliary roller 15 and sheet return lever 12. To cope with this, as described above, the configuration of the paper feed auxiliary roller 15 is different from that of the paper feed roller 3, whereby an unnecessary bending is not imparted to the printing sheet P and the sheet transport load increase is not caused.

In FIG. 6, a printing sheet P indicated by a phantom line is a printing sheet of A4 size vertically set. And in the present embodiment, the paper feed roller 3 and the paper feed auxiliary roller 15 are uniformly disposed in conformity with the width size of the printing sheet P of A4 size as shown. With this feature, the feeding attitude of the printing sheet P of A4 size, which is generally most frequently used, is controlled to be most uniform. The paper feed auxiliary roller 15 for controlling the feeding attitude of the printing sheet P is most efficiently operated. The paper feed auxiliary roller 15 may be disposed at any position if it allows the printing sheet P to normally be fed, viz., it allows the printing sheet P feeding attitude to be controlled.

A second function of the paper feed auxiliary roller 15 is a function as a "twist restricting member" for restricting a twist of the paper feed roller shaft 3*a*. The paper feed roller shaft 3*a* serves as a drive force transmission shaft which receives a rotational force from the transmission gear device 17 provided on the left side of the printer (the left side in FIG. 6) and transmits the drive force to the hopper release device to be given later, provided on the right side of the printer (the right side in FIG. 6). Accordingly, when the drive force is transmitted to the hopper release device or when the printing sheet is fed by the paper feed roller 3, a load is imparted to the paper feed roller shaft 3*a*. As a result, a twist is caused in the paper feed roller shaft 3*a*. When a twist is caused in the paper feed roller shaft 3*a*, a phase shift occurs in the rotating operation of the paper feed roller 3 or in the operation of the hopper release device fed with the drive force. In this state, it is impossible to secure a normal paper feeding operation and a normal drive force transmission. Particularly, the paper feed roller 3 is located at a position on the paper feed roller shaft 3*a*, which is deviated to the side remote from the shaft end (the left side in FIG. 6) which receives a rotational force. Accordingly, it more easily receives the influence of the twit.

With provision of the paper feed auxiliary roller 15 on the paper feed roller shaft 3*a*, a twist is reduced at a part at which the paper feed auxiliary roller 15 is provided. The result is to alleviate the phase shift problem caused by the twist. If such a twist restricting part may be provided at another appropriate position, the phase shift problem is further alleviated. In this case, it is not essential that its configuration is the same as of the paper feed roller 3. It may take any configuration if its radial size is larger than that of the paper feed roller shaft 3*a*. In addition, in the instant embodiment, the paper feed roller shaft 3*a*, paper feed roller 3 (roller body 3*c*), and paper feed auxiliary roller 15 (roller body 15*c*) are integrally formed by using ABS resin. By so doing, the cost of manufacture those components is reduced. The integrated construction further restricts the twist. Even in a case where the paper feed auxiliary roller 15 and the paper feed roller shaft 3*a* are separately provided, and the former is mounted on the latter by adhesive, for example, the adhering by the adhesive will produce a given the twist restricting effect.

The rubber member 15*b* is wound around the outer peripheral part of the paper feed auxiliary roller 15. In the instant embodiment, the rubber member 15*b* is made of EPDM (ethylene polypropylene rubber), like the rubber member 3*b* wound on the outer periphery part of the paper feed roller 3. In the embodiment, an additive is further added to the EPDM of the rubber member 3*b*. As a result, the rubber member is improved in tension strength. The reason why the tension strength of the rubber member 15*b* wound on the paper feed auxiliary roller 15 is selected to be higher than that of the rubber member 3*b* wound on the paper feed roller 3, will be described hereunder.

To protect the printing surface of the printing sheet P, a elastic member is preferably wound on the outer peripheral part of the paper feed auxiliary roller 15 as in the previous case. In the light of cost reduction, it is not desirable to use the elastic member having the width equal to that of the paper feed roller 3. If the elastic member having the width shorter than that of the paper feed roller 3 is used, its strength is reduced as a whole, and the following problem arises. The guide member 13 for smoothly guiding the printing sheet P downstream, as shown in FIG. 7, is provided at a position opposed to the paper feed auxiliary roller 15. And, as shown in FIG. 6, the paper feed auxiliary roller 15 is disposed the two guide surfaces 13*a*. In such a construction, if a number of printing sheets P are fed in a double-feeding manner, a bundle of printing sheets P is nipped between the paper feed auxiliary roller 15 and the two guide surfaces 13*a*, viz., paper jamming occurs.

In the paper feed unit 1 which is constructed such that when paper jamming, for example, occurs, the paper feed roller 3 is stopped, the following problem occurs when the jamming occurs. When the roller is stopped, the drive motor 169 (see FIG. 4) for driving the paper feed roller 3 is under magnetic excitation. When the user tries to pull out the sheet bundle being jammed, the paper feed roller shaft 3*a* is not rotated, Therefore, if the user forcibly pulls out it, there is a danger that the rubber member 15*b* is broken.

By improving the tension strength of the rubber member 15*b* wound on the paper feed auxiliary roller 15, there is no fear that the rubber member 15*b* wound on the paper feed auxiliary roller 15 is broken even in such a situation that the jamming occurs between the paper feed auxiliary roller 15 and the two guide surfaces 13*a*, and the sheet bundle jammed is forcibly pulled out. Further, the width size of the rubber member may be reduced, leading to cost reduction.

In the present embodiment, as shown in FIG. 6, the width of the paper feed auxiliary roller 15 is shorter than that of the paper feed roller 3. With this feature, the rubber member 15*b* is reduced in cost, and a space around the paper feed auxiliary roller 15 is saved. Accordingly, when the paper feed unit 1 is coupled to the carriage unit 120 (see FIG. 1), the component parts of the carriage unit 120 may be arranged in high freedom. Further, the width of the roller body 15*c* of the paper feed auxiliary roller 15 is equal to or longer than that of the paper feed roller 3, and the width of the rubber member 15*b* wound around the paper feed auxiliary roller remains unchanged. This feature of the embodiment further effectively restricts the twist of the paper feed roller shaft 3*a*, and produces various advantageous effects of the paper feed auxiliary roller 15. The elastic members that are wound on the outer peripheral part of the guide member 13 and the paper feed auxiliary roller 15 may be made of any of other materials than the material (rubber member; EPDM). For example, butyl rubber or the like may be used. The paper feed roller 3 can secure a friction coefficient which ensures a normal feeding of printing sheet P. The paper feed auxiliary roller 15 may take any form if it is able to protect the printing surface of the printing sheet P and is low in cost.

Next, a sheet holder member 14 is provided at a position facing the hopper 6 in FIG. 7. The sheet holder member is rotatable around a rotation shaft 14*a* clockwise and counterclockwise in FIG. 7 (In the instant embodiment, two sheet holder members are provided on both sides of the paper feed roller 3, although not shown.). The sheet holder member 14 slightly presses down the printing sheets P stacked on the hopper 6 by its weight, thereby preventing the floating up of the printing sheets P stacked on the hopper 6. The sheet return lever 12 is provided under the hopper 6. The sheet return lever is driven to turn around a rotation shaft 12*a* by a cam mechanism (not shown) (In the embodiment, two sheet return levers are provided on both sides of the paper feed roller 3, see FIGS. 6 and 8B). The sheet return lever 12 returns printing sheets P staying at position near the separation pad 8, which is provided for preventing the double feeding of printing sheets, to the hopper 6, and ensures a normal paper feeding of the next printing sheet P.

The description thus far made is the elaboration of the paper feed unit 1.

Hopper Release Device Construction

Figure 10:
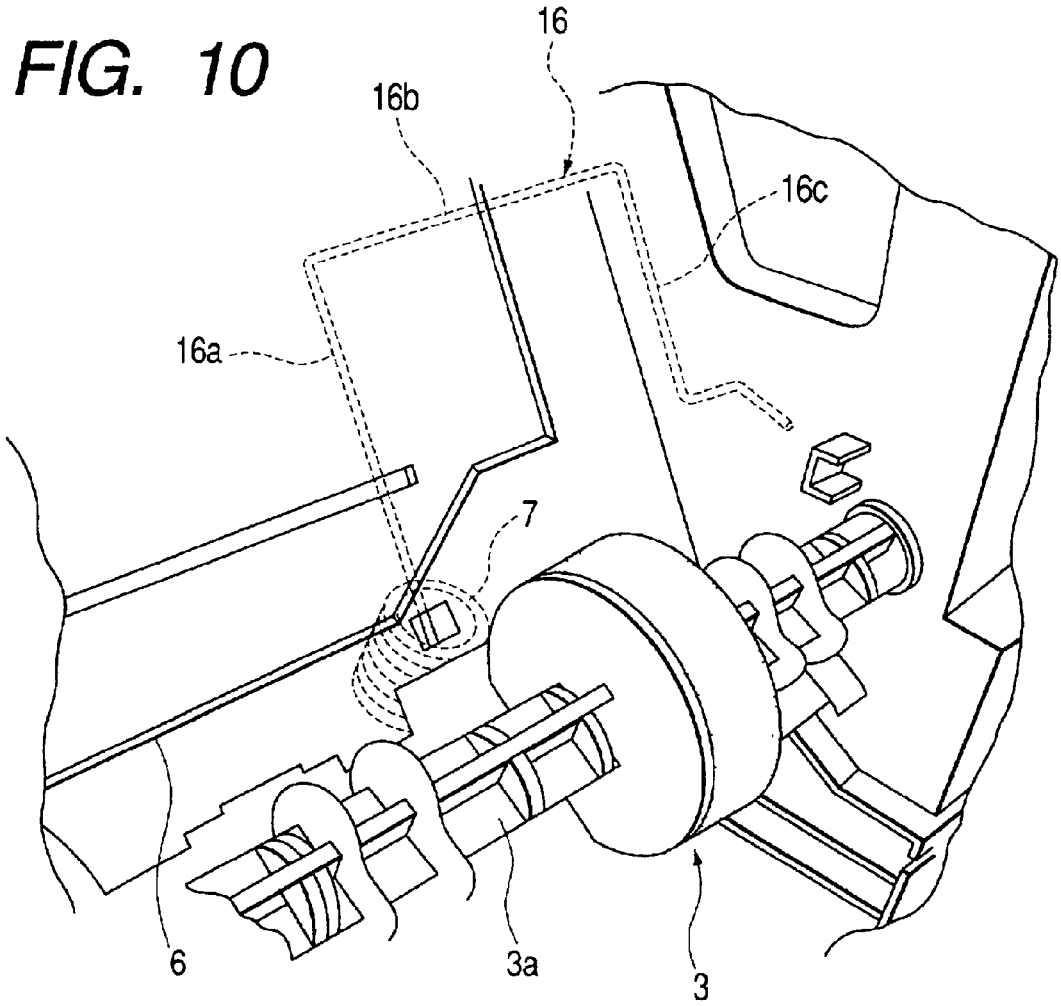
FIG. 10 is a perspective view showing a paper feeder constructed according to the invention (partially enlarged view)
Figure 11:
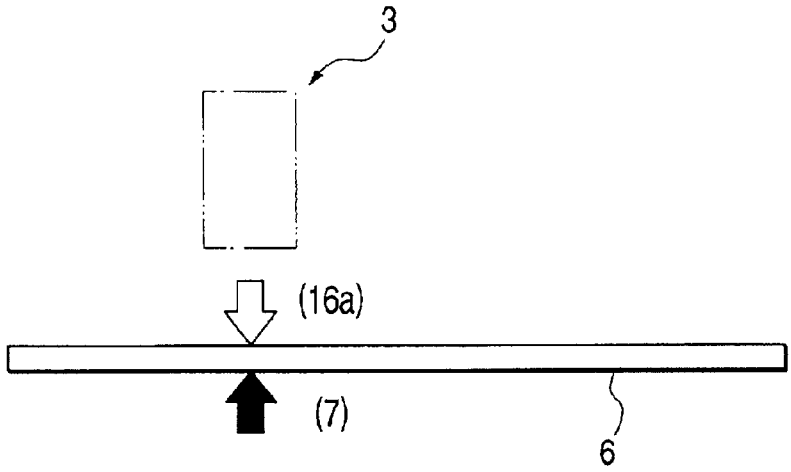
FIG. 11 is a model diagram showing an action position of an external force acting on a hopper 6.
Figure 12A:
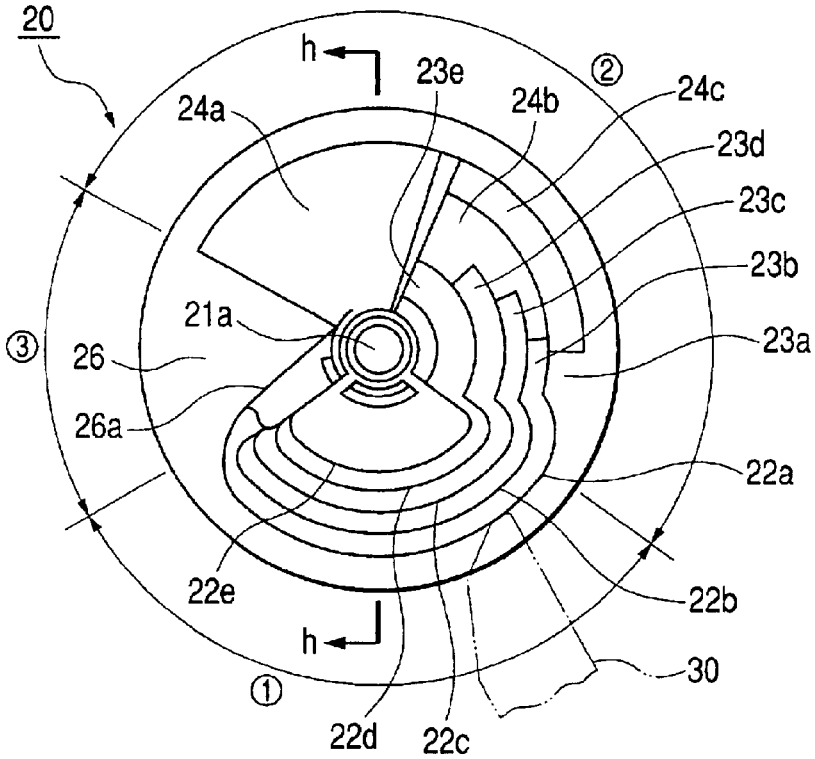
FIG. 12A is a front view showing a rotary cam.
Figure 12B:
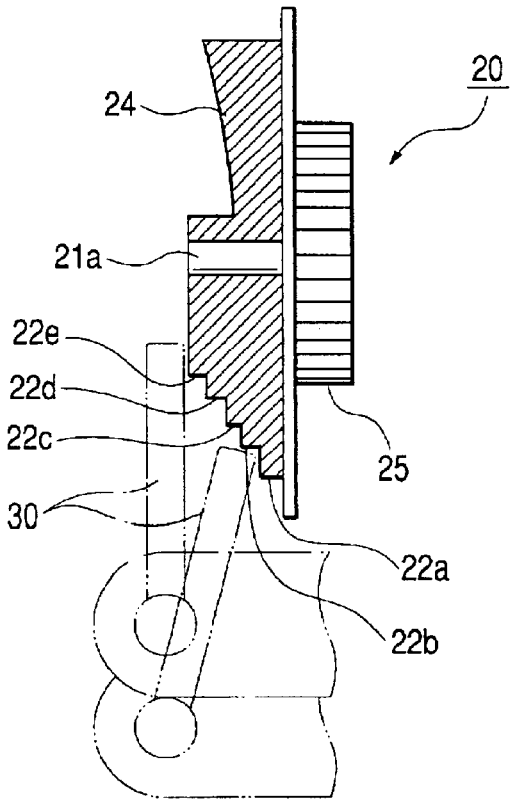
FIG. 12B is a cross sectional view taken on line h—h in FIG. 12A.
Figure 13A:
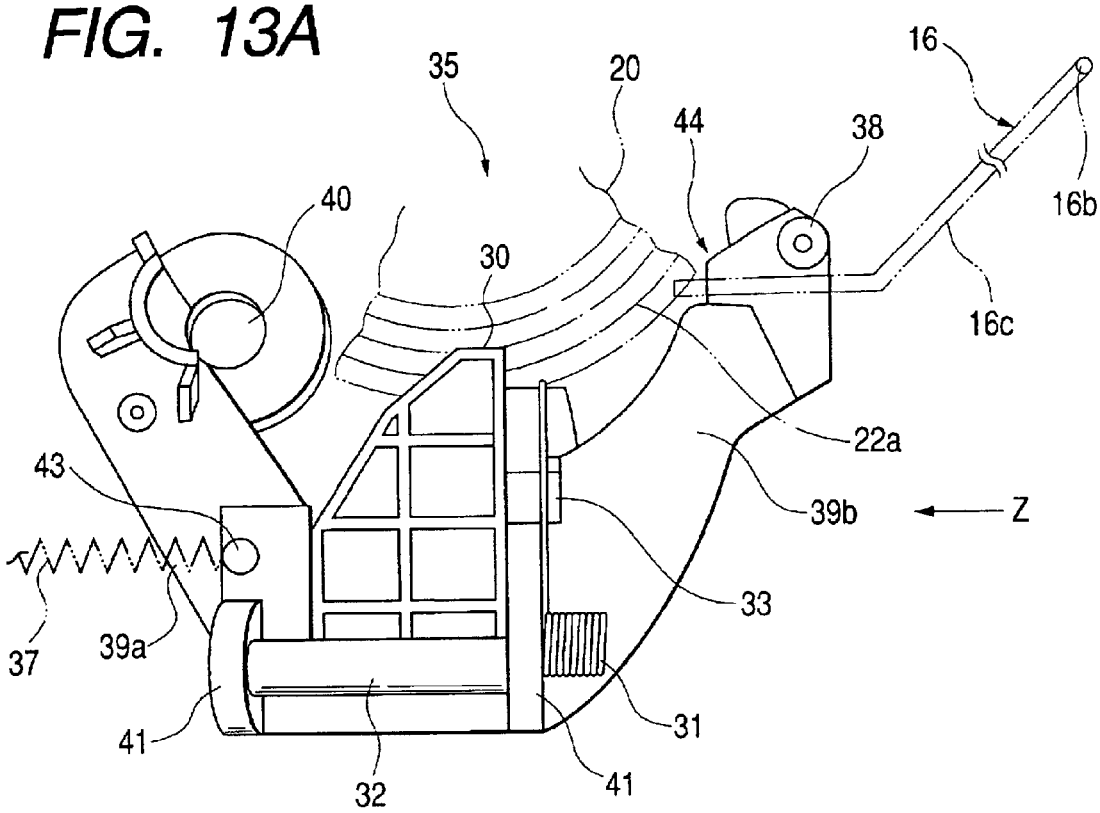
FIG. 13A is a front view showing a cam holder and FIG. 13B is a side view showing the same.
Figure 13B:
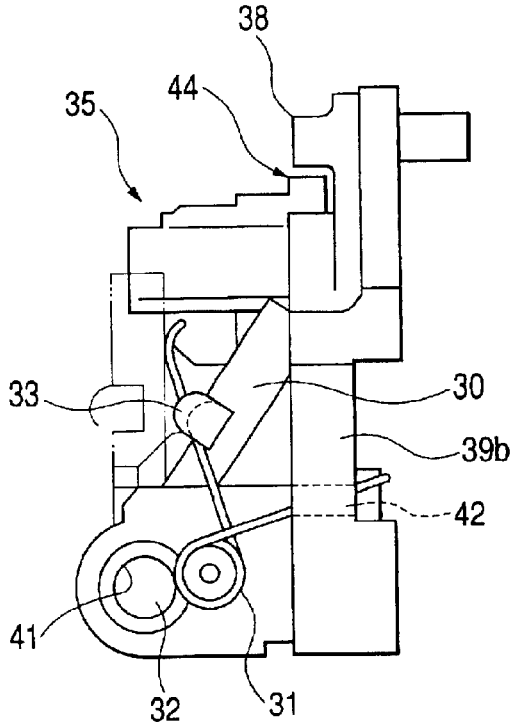

A mechanical arrangement of the hopper release device which turns the hopper 6 in a direction in which it move apart the paper feed roller 3, will be described with reference to FIGS. 10 through 13B, and other figures. FIG. 10 is a partially enlarged, perspective view showing of the paper feed unit 1, and FIG. 11 is a model diagram showing an action position of an external force acting on a hopper 6. FIG. 12A is a front view showing a rotary cam 20, and FIG. 12B is a cross sectional view taken on line h—h in FIG. 12A. FIG. 13A is a front view showing a cam holder 35 and FIG. 13B is a side view showing the same (as viewed in an arrow direction in FIG. 13A).

As described above, the hopper release device is installed on the right side surface (this side in FIG. 5: the right side in FIG. 6) of the paper feed unit 1. A power transmission gear 11 is mounted on the right side end of the paper feed roller shaft 3*a* in FIG. 5. The power transmission gear 11 is in mesh with a gear part 25 (see FIG. 12B) formed on the rear side of the rotary cam 20, which is rotatably supported on a rotation shaft 21, whereby the rotary cam 20 is driven to rotate. Exactly, the rotary cam 20 rotates with rotation of the paper feed roller 3. The hopper release device does not include a drive source, and hence, is low in cost. The power transmission gear 11 directly engages with the rotary cam 20, and the number of teeth of the power transmission gear 11 is equal to that of the gear part 25. Accordingly, when the paper feed roller 3 is rotated clockwise by one turn, then the rotary cam 20 is rotated counterclockwise by one turn.

A cam lever 30 and a cam lever holder 35, which are swung with rotation of the rotary cam 20, are provided under the rotary cam 20. The hopper release device to be described in detail hereunder successively engages with the rotary cam 20, cam lever 30 and cam lever holder 35 in this order. By the swing operation of the cam lever holder 35, a release bar 16 (see FIG. 10) is turned which engages with the backside of the hopper 6 (the right side in FIG. 7), and then the hopper 6 is turned. The outline of the hopper release device is as described above.

The description to follow is the construction, operation and effects of the release bar 16 provided on the backside of the hopper 6. As shown in FIG. 10, the release bar 16 is shaped like reverse U. The release bar includes a first shaft part 16*b* which extends in the longitudinal direction (the width direction of the printing sheet P) of the hopper 6, a second shaft part 16*a* which vertically extends from one end of the first shaft part 16*b* to a position near the compression coiled spring 7, and a third shaft part 16*c* which extends from the other end of the first shaft part 16*b* substantially parallel to the second shaft part 16*a*.

For the release bar 16, the first shaft part 16*b* is axially supported by a bearing part 18 located above a sub-frame 19 shaped like V. With this structure, the second shaft part 16*a* and the third shaft part 16*c* are rotatable around the first shaft part 16*b* clockwise and counterclockwise in FIG. 7.

An engaging part 6*c* (see FIG. 7) with which the tip of the second shaft part 16*a* engages is provided on the backside of the hopper 6. As shown in FIGS. 13A and 13B, the cam lever holder 35, which will be described in detail, includes a recess 44, defined by a protruded part 38, which serves as "hopper acting part" to which the bent tip part of the third shaft part 16*c* is fit. When the cam lever holder 35 is turned clockwise and counterclockwise in FIG. 13A, the release bar 16 is turned around the first shaft part 16*b*, and the hopper 6 is turned. That is, the cam lever holder 35, cam lever 30 and rotary cam 20 make up "release bar turning device" for turning the release bar 16.

An engaging part where the release bar 16 engages with the hopper 6, viz., a position where the third shaft part 16*c* is located, is substantially coincident with a position of the compression coiled spring 7, as shown in FIGS. 7 and 10. Accordingly, an action point at which the release bar 16 imparts a force to the hopper 6 and an action point where the compression coiled spring 7 imparts a force on the hopper 6 are located at substantially the same position. Therefore, little bending moment is generated in the hopper 6. Deformation of the hopper 6 is prevented, and hence, a normal sheet feeding operation is maintained.

More exactly, as shown in FIG. 11, the hopper 6 is a plate member elongated in the width direction of the printing sheet P. When an action point (a white arrow in FIG. 11) where the release bar 16 (the second shaft part 16*a*) imparts a force onto the hopper 6 and an action point (a black arrow in FIG. 11) where the compression coiled spring 7 imparts a force onto the hopper 6, are not coincident with each other in the horizontal direction in FIG. 11 and in the vertical direction with respect to the sheet of drawing, viz., on the plane of the hopper 6, a bending moment is generated in the hopper 6. As a result, the hopper 6 is temporarily or permanently bent. When the hopper 6 is thus put to a bending state, a maximum number of printing sheets P as set is reduced, a skew occurs during the feeding of the printing sheet P or other disadvantages occur.

As described above, in the paper feed unit 1, an action point where the release bar 16 imparts a force on the hopper 6 is substantially coincident in position with an action point where the compression coiled spring 7 imparts a force to the hopper 6 in the plane of the hopper 6 as shown in FIG. 11. Therefore, little bending moment is generated in the hopper 6, the hopper 6 is never bent, and hence, the normal paper feeding operation is retained. The fact that the action points of force are coincident on the hopper 6 enables the hopper to swing at high speed and stably.

Next, the rotary cam 20 as the release bar rotating device for turning the release bar 16, cam lever 30 and cam lever holder 35 will be described.

Firstly, as shown in FIG. 12A, the rotary cam 20 is shaped like a disc when viewed from front and includes the rotation shaft 21 (see FIG. 5), which is inserted into a shaft hole 21*a*, and is turned around the rotation shaft. Further, the rotary cam includes a stepped cam part (within a region (1) in FIG. 12A), which stepwise rises from the periphery toward the shaft hole 21*a*. The stepped cam part is formed with fan-shaped cams 22*a* to 22*e*, which are shaped like a fan shape when viewed from front, and engage with the cam lever 30 at their peripheral surfaces. A cam lever guide part (within a region (2) in FIG. 12A) is located adjacent to the fan-shaped cam 22*a*, and includes a guide face 23*a* and fan-shaped guide faces 23*b* to 23*e* for guiding the cam lever 30 to the outer peripheral surface of the fan-shaped cams 22*a* to 22*e*, and guide slopes 24*a* to 24*c* for guiding the cam lever 30 to the guide face 23*a* and the fan-shaped guide faces 23*b* to 23*e*. The cam lever guide part guides the cam lever 30 to the outer peripheral surface of any of toothed cams corresponding to an amount of stacked printing sheets P.

The guide face 23*a* and the fan-shaped guide faces 23*b* to 23*e* are located shifted, one by one, to the inner side of the rotary cam 20, from the outer peripheral surface of the fan-shaped cams 22*a* to 22*e*. With such an arrangement, when the rotary cam 20 is turned (counterclockwise in FIG. 12A), the cam lever 30 being in abutment with the guide face 23*c*, for example, is brought into engagement (pressing contact) with the outer peripheral surface of the fan-shaped cam 22*b*. The fan-shaped guide faces 23*b* to 23*e*, as shown in FIG. 12A, are shaped so that their phases (the start points of their arcs) are spirally shifted.

The guide slopes 24*a* to 24*c* function to guide the cam lever 30 located at a non-cam part 26 (to be described later) to the guide face 23*a* and the fan-shaped guide faces 23*b* to 23*e*. The guide slope 24*a*, as shown in FIG. 5, gradually rises while turning clockwise around the rotary cam 20; it has a height being uniform in the radial direction (in FIG. 12B the left side corresponds to a high side of it); it is connected at the inner side to the fan-shaped guide face 23*e* at substantially the same level; it is connected at the central part as radially viewed to the guide slope 24*b* inclined to the fan-shaped guide faces 23*b* to 23*d*, which is located at a position lower than the guide face 23*e*; and it is connected at the outer periphery to the guide slope 24*c* inclined to the guide face 23*a*.

The non-cam part 26 formed with a flat disc surface (within a region (3) in FIG. 12A) is provided adjacent to the fan-shaped cams 22*a* to 22*e*. The non-cam part 26 does not restrain the cam lever 30 in the radial direction of the rotary cam 20. Accordingly, when the rotary cam 20 is turned (counterclockwise in FIG. 12A) to enter the region of the non-cam part 26, the cam lever 30 being in engagement with the fan-shaped cam 22*a* located on the radially outermost side, is displaced to the center of the rotation of the rotary cam 20 from its state till the uppermost printing sheet P is abutted against the paper feed roller 3 under the urging by the compression coiled spring 7 shown in FIG. 7. Conversely, when the rotary cam 20 is turned clockwise in FIG. 12A, the cam lever 30 which is in the area of the non-cam part 26 is guided from its state to the outer peripheral surface of the fan-shaped cam 22*a* located on the radially outermost side while being guided by a cam surface smoothly continuous to the outer peripheral surface of the fan-shaped cam 22*a*.

Referring to FIGS. 13A and 13B, the cam lever holder 35 takes an arm-like form including an arm 39*a* extended from a shaft hole 40 through which a rotation shaft 36 (see FIG. 5) is made to pass, and another arm 39*b* extending from the arm 39*a* in an upward direction. And it is mounted on the sheet feeding unit frame 2 in a state that it is turned around the center of the shaft hole 40. A spring hooking part 43 is provided on the cam lever holder 35. The sheet feeding unit frame 2 also includes a similar spring hooking part (not shown). A tension coil spring 37 is stretched between those spring hooking parts (see FIG. 5). The tension coil spring 37 generates such a spring force as to turn the cam lever holder 35 clockwise in FIG. 13, and with provision of the tension coil spring, it is operated in a state that the protruded part 38 is always in contact with the release bar 16.

In FIG. 13A, when the cam lever holder 35 is turned clockwise in the figure, the release bar 16 (third shaft part 16*c*) is turned counterclockwise, so that the hopper 6 is turned in such a direction as to move apart from the paper feed roller 3. At this time, the cam lever holder 35 turns the hopper 6 while resisting the spring force of the compression coiled spring 7 (see FIG. 7). When the cam lever holder 35 is turned counterclockwise in the figure, the release bar 16 (third shaft part 16*c*) is turned clockwise, so that the hopper 6 is turned in such a direction as to be pressed against the paper feed roller 3. In this case, the release bar 16 and the cam lever holder 35 are turned by a spring force of he compression coiled spring 7 (see FIG. 7).

The cam lever 30 includes a rotation shaft 32. The rotation shaft 32 is supported by a bearing part 41 formed on the cam lever holder 35. As indicated by phantom lines in FIGS. 12A and 13B, it is swung in the axial direction of the rotary cam 20. A spring hooking part 33 is provided on the cam lever 30. A hole part 42 is formed in the cam lever holder 35. A twisted coil spring 32 is provided between them. Accordingly, the cam lever 30 is pulled toward the rotary cam 20 by the spring force of the twisted coil spring 31, and is always in contact with the rotary cam 20.

Engaging operations of the rotary cam 20, cam lever 30 and cam lever holder 35 thus constructed will be described in brief. In FIG. 12A, as indicated by a phantom line and designated reference numeral 30, the cam lever is in pressing contact with the outer peripheral surface of the fan-shaped cam 22*a*. A case where the rotary cam 20 is turned by one turn (360°) from this state will be described.

When the cam lever 30 is put on the fan-shaped cam 22*a*, as seen from FIG. 13A, the cam lever holder 35 is at a position at which it has been fully turned clockwise, and the hopper 6 is located farthest from the paper feed roller 3. When the rotary cam 20 is turned counterclockwise in FIG. 12A, the cam lever 30 is moved out of the fan-shaped cam 22*a* and enters the region of the non-cam part 26 (region (3). And the cam lever is displaced toward the center of rotation of the rotary cam 20. Thus, the cam lever 30 is displaced to the center of rotation of the rotary cam 20, and then the cam lever holder 35 is turned counterclockwise in FIG. 13A. And, the hopper 6 is turned in such a direction as to be pressed against the paper feed roller 3, by the urging force of the compression coiled spring 7.

When an amount of printing sheets P stacked on the hopper 6 is large, the swing angle of the hopper 6 is small. Accordingly, even if the cam lever 30 is out of the fan-shaped cam 22*a*, it is displaced to the rotation center of the rotary cam 20, by a small quantity. Conversely, when an amount of printing sheets P stacked on the hopper 6 is small, the swing angle of the hopper 6 is large. Accordingly, in this case, the cam lever 30 is moved greatly out of the fan-shaped cam 22*a*, it is displaced to the rotation center of the rotary cam 20, by a large quantity.

When the rotary cam 20 is further turned counterclockwise in FIG. 12A, the cam lever 30 enters the cam lever guide part (region (3)), and starts its engagement with the guide slope 24*a*. At this time, the cam lever 30 swings in the axial direction of the rotary cam 20 (see FIG. 12B), while it is not displaced in the radial direction of the rotary cam 20, and is guided to one of the fan-shaped guide face 23*e*, guide slope 24*b* (then, to the fan-shaped guide faces 23*b* to 23*d*), and guide slope 24*c* (then, to the guide face 23*a*).

As described above, a position as viewed in the radial direction of the rotary cam 20 at which the cam lever 30 is present varies depending on the amount of printing sheets P stacked on the hopper 6. The place where the cam lever 30 is to be guided, i.e., one of the fan-shaped guide face 23*e*, guide slope 24*b* (then, to the fan-shaped guide faces 23*b* to 23*d*), and guide slope 24*c* (then, to the guide face 23*a*), depends on the amount of stacked printing sheets P. Accordingly, when the amount of the stacked printing sheets P is small, the cam lever 30 is guided to the fan-shaped guide face 23*e*. When the amount of the stacked printing sheets P is large, the cam lever 30 is guided to the guide slope 24*c* (then, to the guide face 23*a*).

When the rotary cam 20 is further turned, the cam lever 30 moves from one of the guided guide face 23*a* and the fan-shaped guide face 23*b*, viz., the current position as viewed in the radial direction on the rotary cam 20, and climbs on the outer periphery of the fan-shaped cam (fan-shaped cams 22*a* to 22*e*) which is closest to the outer periphery. In other words, the cam lever 30 is slightly displaced in the radial direction of the rotary cam 20 (from the center of rotation of the rotary cam 20 to the outer periphery),and the cam lever holder 35 is slightly turned clockwise in FIG. 13A. As a result, the hopper 6 is slightly swung in such a direction as to move apart from the paper feed roller 3. And, of the printing sheets P having been abutted on the paper feed roller 3, the uppermost printing sheet P is slightly separated from the paper feed roller 3 (in free state). The outline of the engaging operation of the rotary cam 20, cam lever 30 and cam lever holder 35 is as described above. Thus, the hopper release device has three modes. A first mode is a "large release mode" in which the hopper 6 is turned to be farthest from the paper feed roller 3 (a state that the cam lever 30 is abutted on the outer periphery surface of the fan-shaped cam 22*a* located at the outermost periphery). A second mode is a "non-release mode" in which the hopper 6 is brought into pressing contact with the paper feed roller 3 (a state that the cam lever 30 is in the non-cam part 26 (region (3) or the cam lever guide part (region (2)). A third mode is a "small release mode" in which the hopper 6 is turned so that the uppermost printing sheet P is slightly separated from the paper feed roller 3, and its state is retained (a state that the cam lever 30 has been transferred from the region (2) to the region (1)). Any of those modes may be executed as desired by controlling the turning of the rotary cam 20 (paper feed roller shaft 3*a*).

In the instant embodiment, the number of steps of the stepped cam part (fan-shaped cams 22*a* to 22*e*) formed on the rotary cam 20 is five (5). As seen from the description, as the number of steps of the stepped cam part is larger, the hopper 6 is controlled in accordance with the amount of stacked printing sheets P more finely, as a matter of course.

Figure 14:
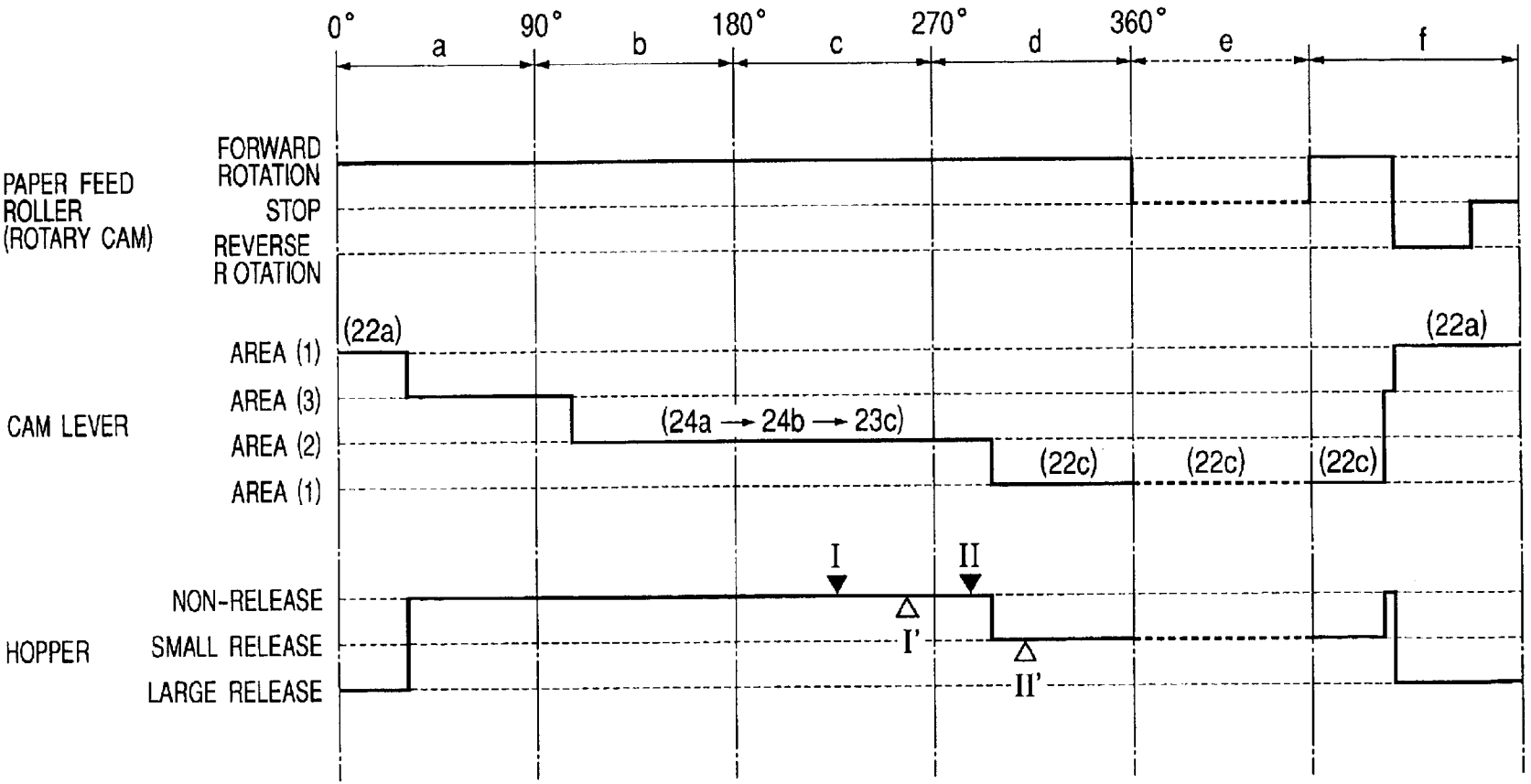
FIG. 14 is a timing chart showing operational transitions of the paper feed roller, cam lever and hopper.
Figure 15A:
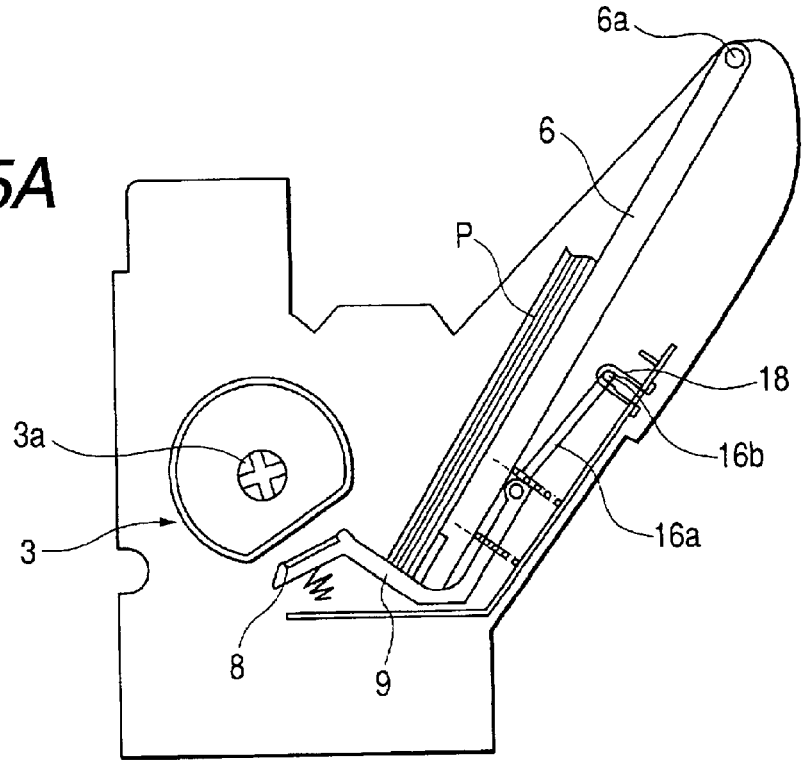
FIGS. 15A and 15B are diagrams for explaining states of the paper feeder during the paper feeding operation of the paper feeder of the invention.
Figure 15B:
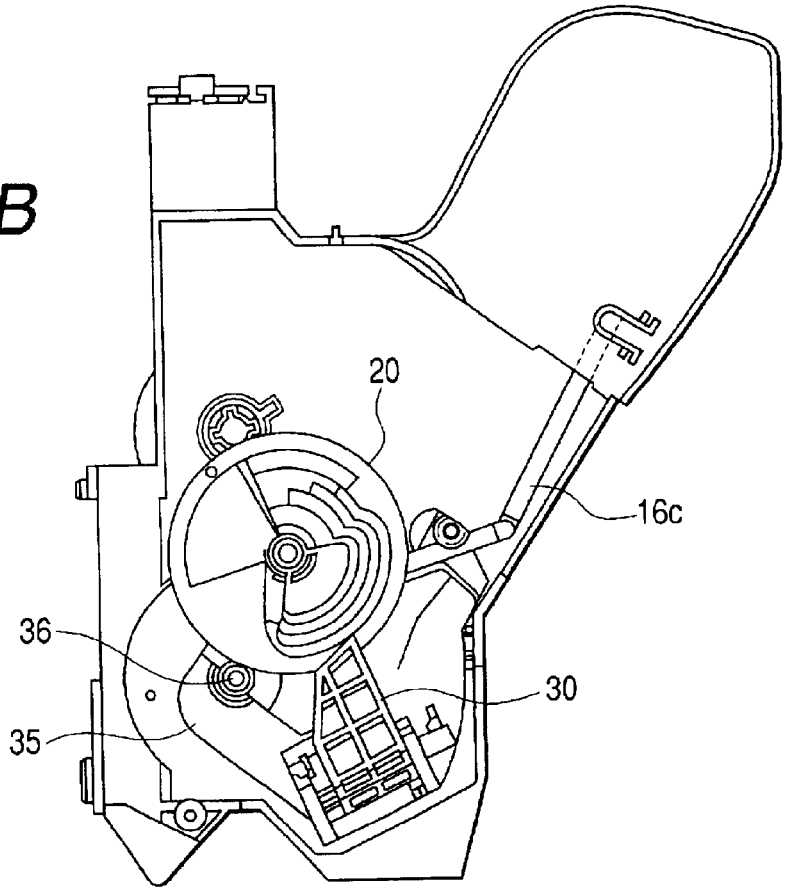

Description will now be given about an actual paper feed control in the paper feed unit 1 and the operation and effects of the hopper release device. In the description, reference is made to FIGS. 14 to 22B. FIG. 14 is a timing chart showing operational transitions of the paper feed roller 3, cam lever 30 and hopper 6. FIGS. 15 to 22B are diagrams for explaining states of the paper feed roller 3, cam lever 30 and hopper 6 in the timing charts shown in FIG. 4. FIGS. 15A to 22A show mainly positional relationships between the paper feed roller 3 and the hopper 6. FIGS. 15B to 22B show mainly engaging states of the cam lever 30 and the rotary cam 20.

The areas (1) to (3) shown in FIG. 14 correspond to the areas of the rotary cam 20 shown in FIG. 12A. numerals attached with alphabetic letters on the chart of the cam lever 30 are indicate the fan-shaped cams 22*a* to 22*e* or guide face 23*a* and fan-shaped guide faces (23*b* to 23*e*) on which the cam lever 30 is abutted. Further, in the figure, "non-release" of the hopper 6 means a state of the hopper 6 when the non-release mode is set up and the printing sheet P set on the hopper 6 is abutted against the paper feed roller 3. "Small release" means a state of the hopper 6 when the small release mode is set up and the printing sheet P (uppermost printing sheet P) set on the hopper 6 is slightly separated from the paper feed roller 3. "Large release mode" means a state of the hopper 6 when the large release mode is set up, and the hopper 6 is farthest from the paper feed roller 3. "Forward rotation" of the paper feed roller 3 means a clockwise rotation of the paper feed roller in FIGS. 15A to 22B. When the paper feed roller 3 is normally rotated, the rotary cam 20 rotates counterclockwise in the figures.

Figure 16A:
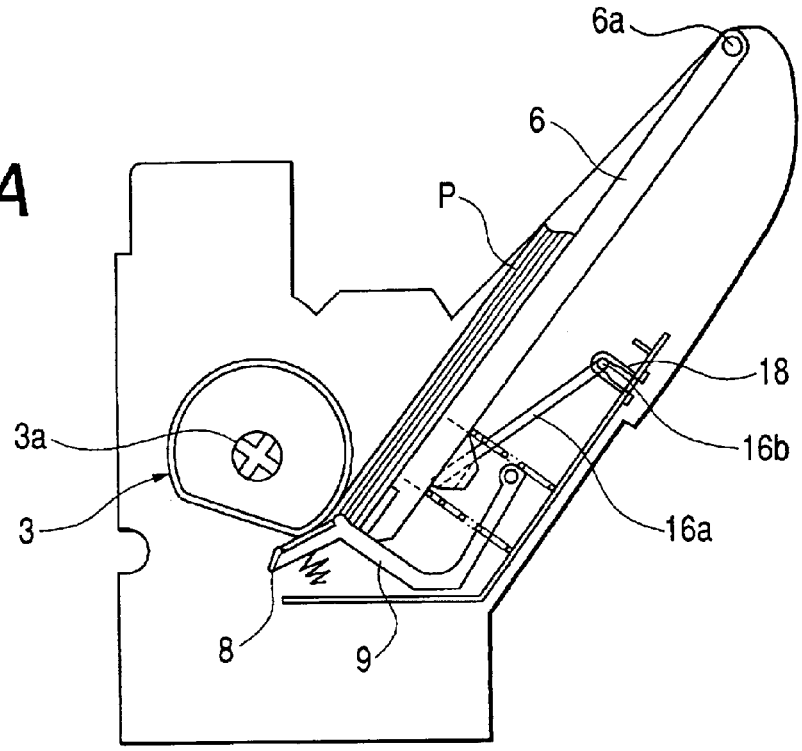
FIGS. 16A and 16B are diagrams for explaining states of the paper feeder during the paper feeding operation of the paper feeder of the invention.
Figure 16B:
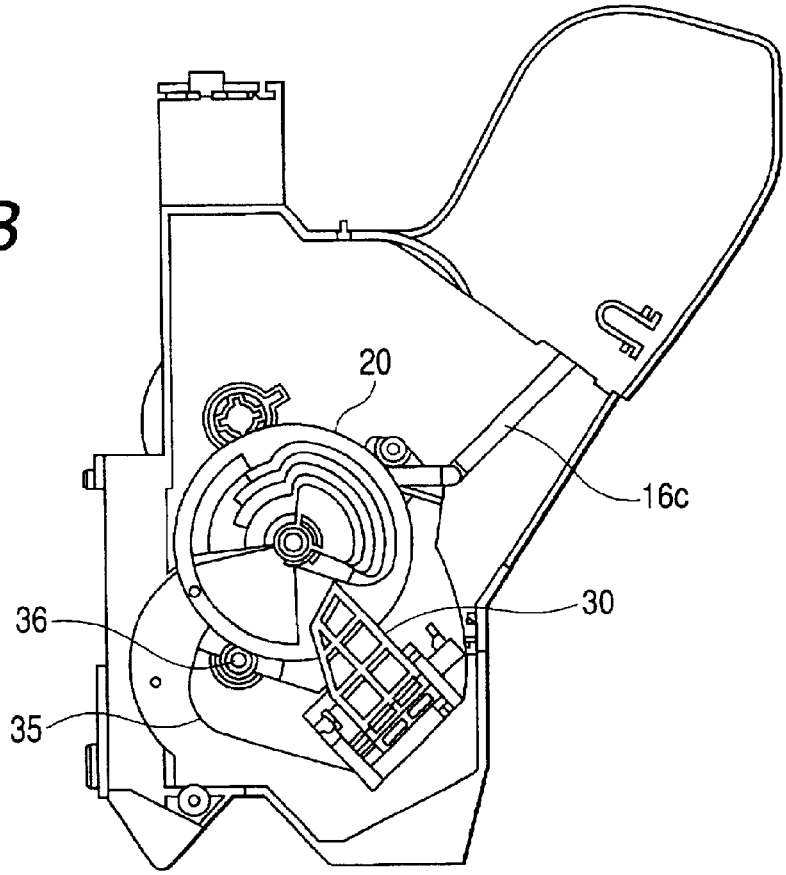

To being with, at the start of paper feeding, the cam lever 30 is put on the fan-shaped cam 22*a*. The hopper 6 is at the largest distance from the paper feed roller 3 (FIG. 15A) The paper feed unit 1 is at a rest state allowing the printing sheet P to be set on the hopper in such a state of the hopper. When the paper feed roller 3 is normally rotated from that state for the purpose of paper feeding, the rotary cam 20 normally rotates counterclockwise in the figure. In turn, the cam lever 30 moves out of the fan-shaped cam 22*a*, enters the region of the non-cam part 26 (region (3) (FIG. 16B), and the printing sheet P set on the hopper 6 is abutted against the paper feed roller 3 (FIG. 16A). In other words, the hopper release device executes the non-release mode (segment "a" in FIG. 14). And, with rotation of the paper feed roller 3, the feeding of the uppermost printing sheet P starts.

Figure 17A:
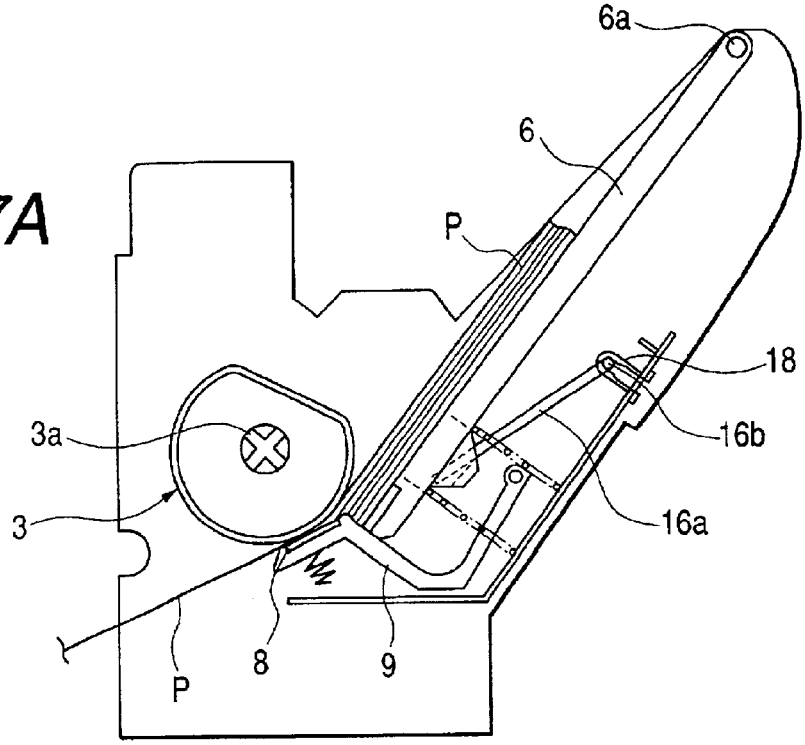
FIGS. 17A and 17B are diagrams for explaining states of the paper feeder during the paper feeding operation of the paper feeder of the invention.
Figure 17B:
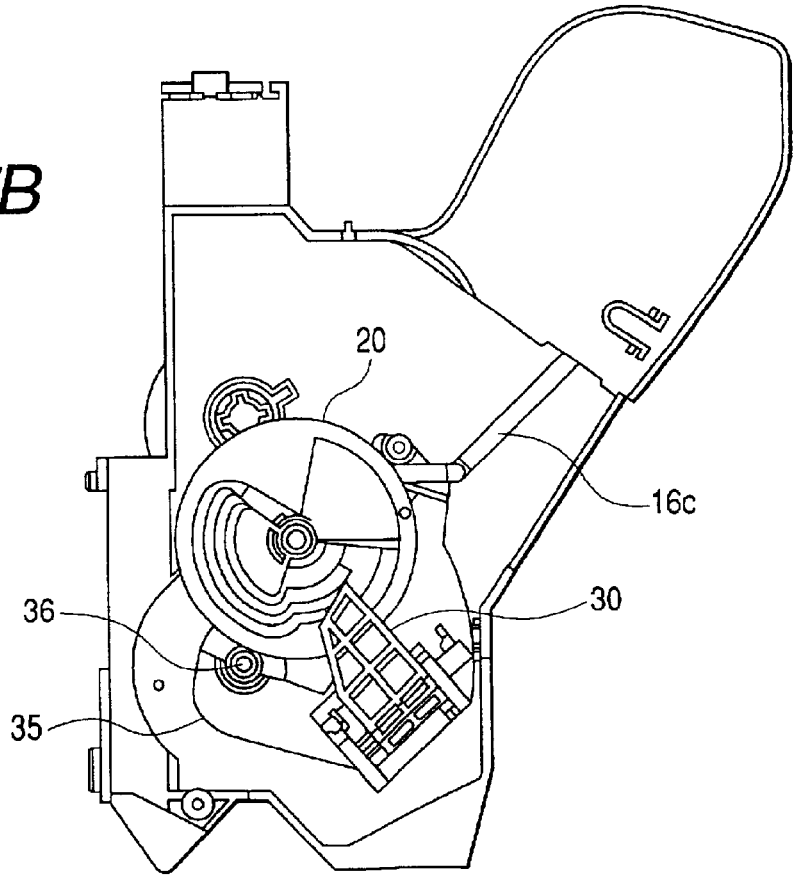

When the paper feed roller 3 is normally rotated, the cam lever 30 starts to engage with the guide slope 24*a* (cam lever guide part: region (2)), and is guided to one of the guide face 23*a* and the fan-shaped guide faces 23*b* to 23*d* depending on the amount of printing sheets P stacked on the hopper 6 (FIG. 17B: in the instant embodiment, it is guided to the guide face 23*c* by way of the guide slope 24*b*). At this time, the printing sheet P set on the hopper 6 is in the non-release state while being abutted the paper feed roller 3 (segments "b" and "c" in FIG. 14).

Figure 18A:
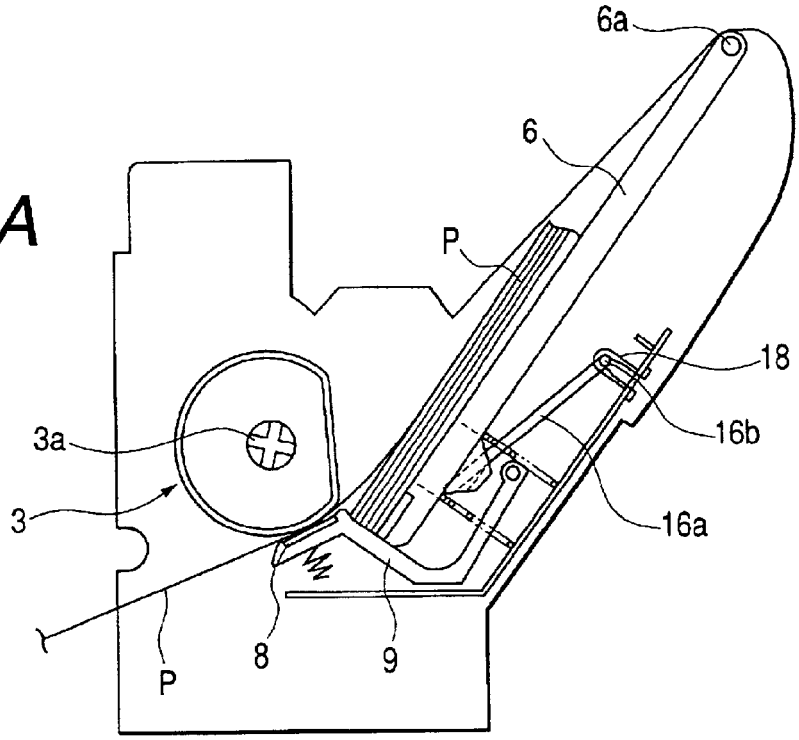
FIGS. 18A and 18B are diagrams for explaining states of the paper feeder during the paper feeding operation of the paper feeder of the invention.
Figure 18B:
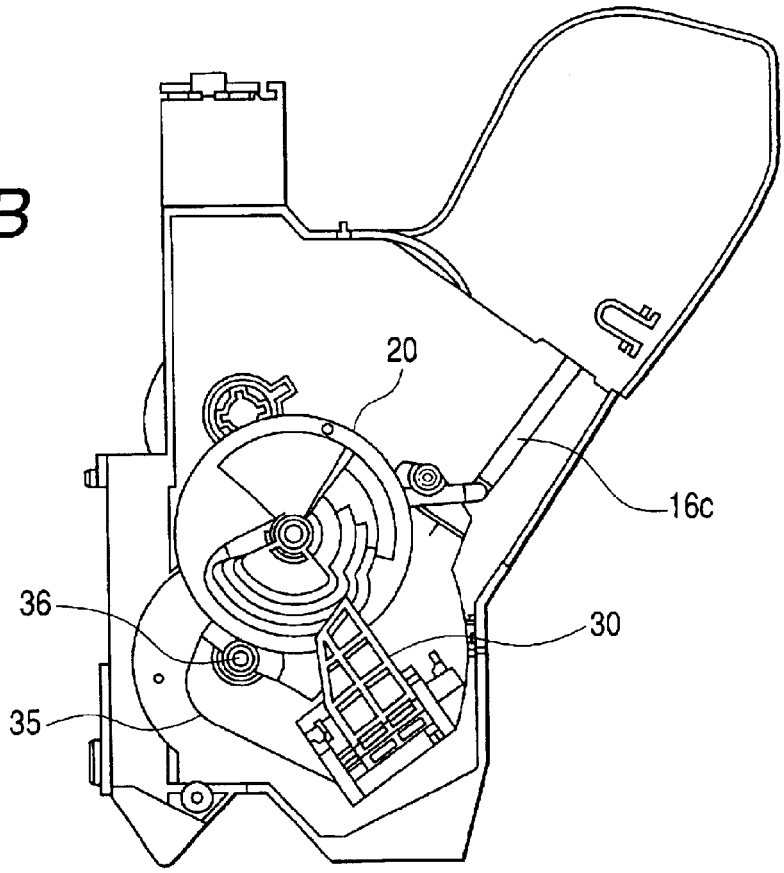
Figure 19A:
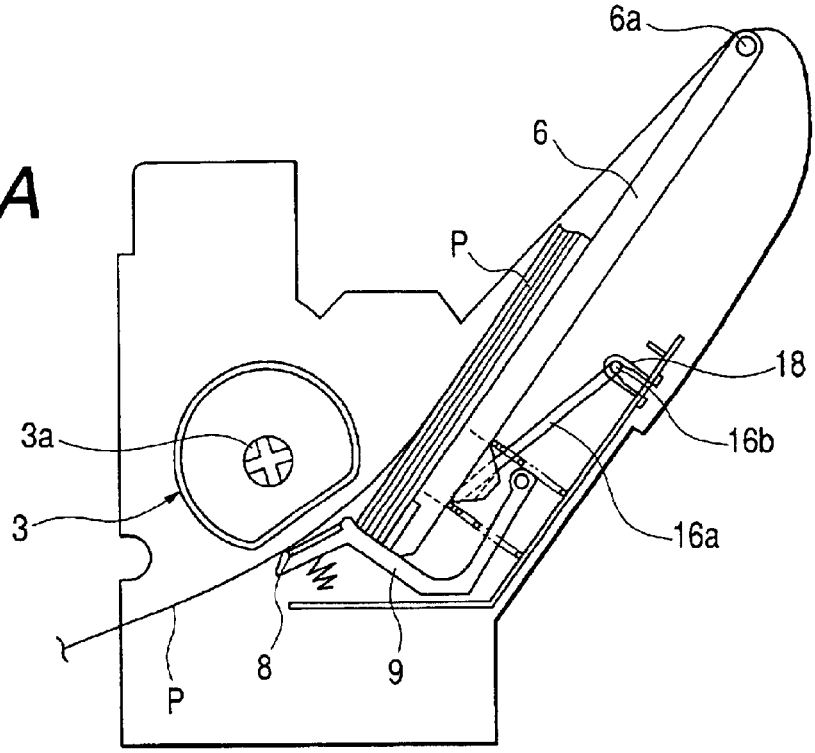
FIGS. 19A and 19B are diagrams for explaining states of the paper feeder during the paper feeding operation of the paper feeder of the invention.
Figure 19B:
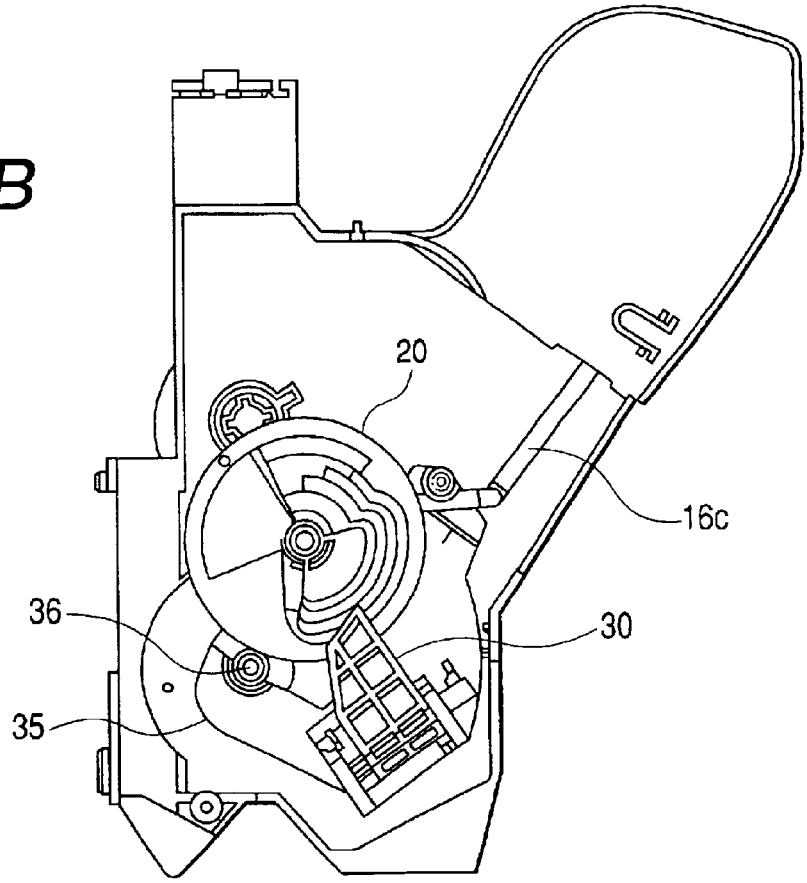
Figure 20A:
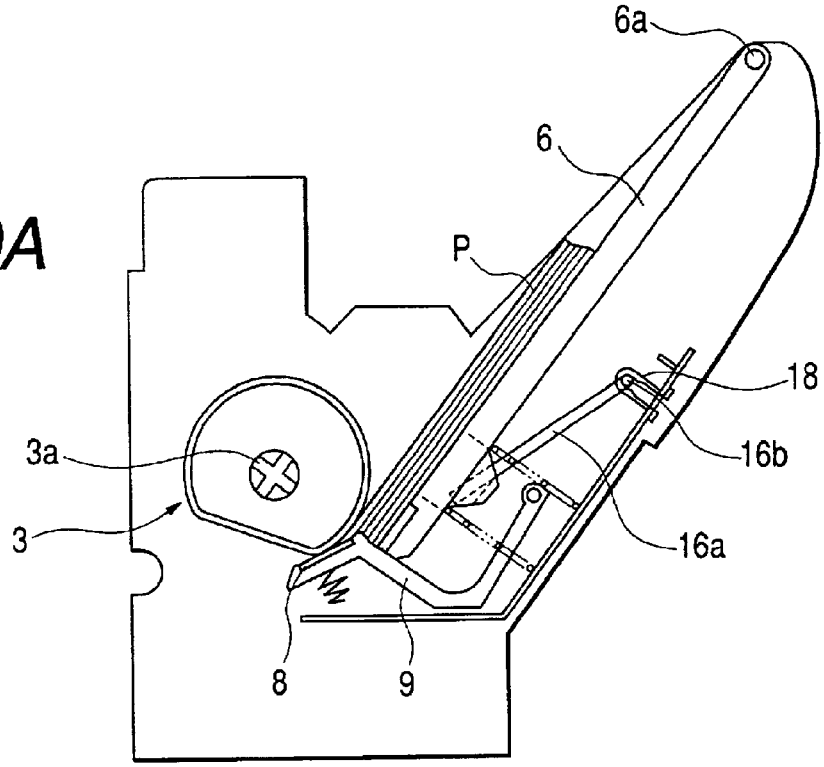
FIGS. 20A and 20B are diagrams for explaining states of the paper feeder during the paper feeding operation of the paper feeder of the invention.
Figure 20B:
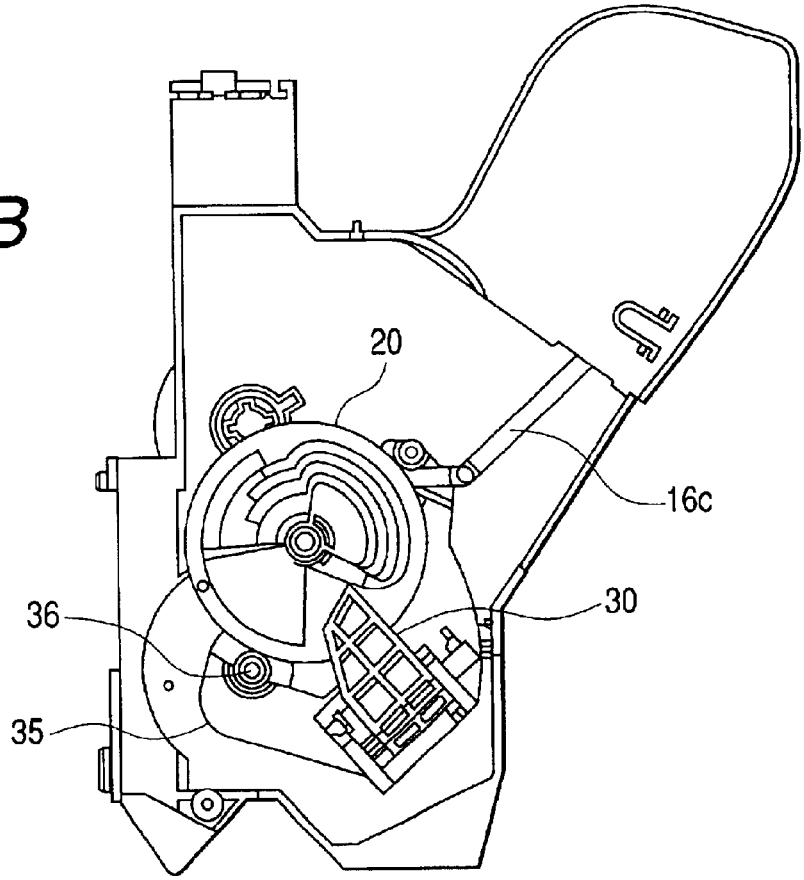
Figure 21A:
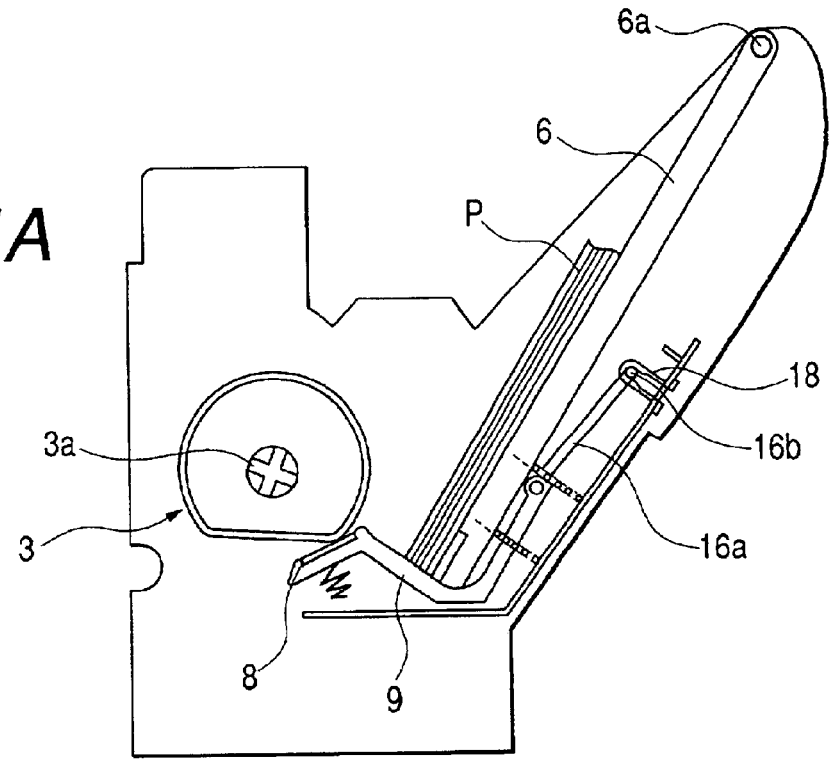
FIGS. 21A and 21B are diagrams for explaining states of the paper feeder during the paper feeding operation of the paper feeder of the invention.
Figure 21B:
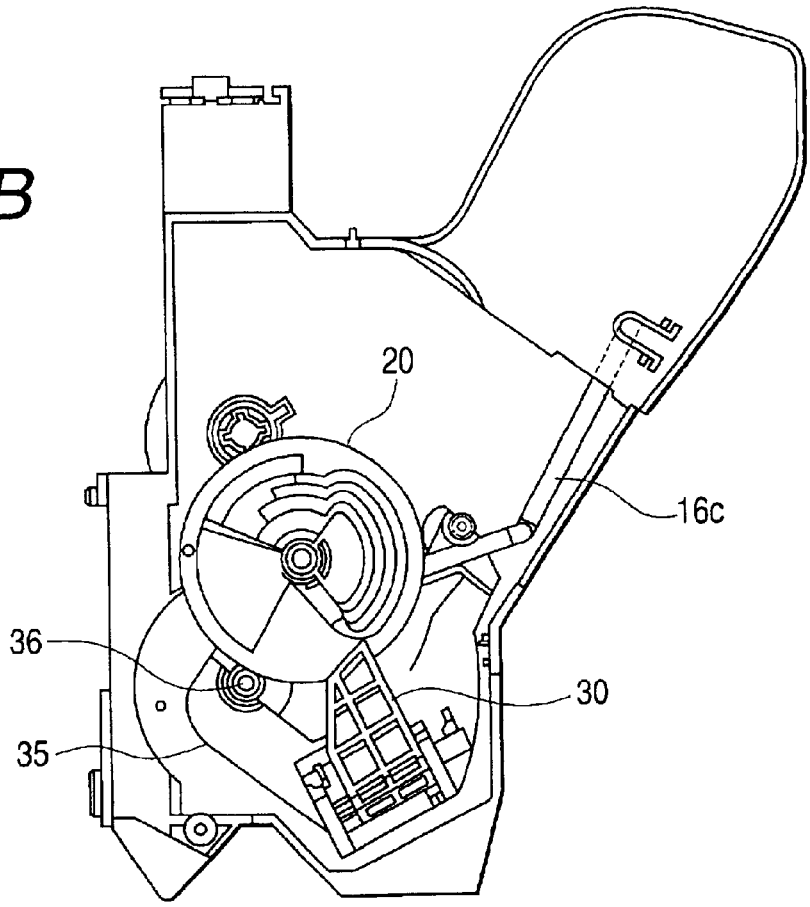

When the paper feed roller 3 is normally rotated, the cam lever 30 climbs from the guide face 23*c* onto the outer periphery of the fan-shaped cam 22*c* (FIG. 8B), and the hopper 6 slightly turns in such a direction as to move apart from the paper feed roller 3 (FIG. 18A). As a result, the printing sheet P is slightly separated from the paper feed roller 3 (FIG. 9A). In other word, the hopper release device executes the hopper release mode (segment "d" in FIG. 14).

And, the paper feed roller 3 rotates one turn (360°), and stops its rotation when the flat part of the paper feed roller, which is shaped like D when viewed from side, is opposed to the separation pad 8, to set up a state that no transport load is imparted to the printing sheet P which is under printing (transported). And, it waits till the feeding of the next printing sheet P starts (FIGS. 19A and 19B) (segment "e" in FIG. 14) Exactly, when a paper feeding job for the next printing sheet P and the subsequent ones is left, the hopper release device does not execute the large release mode which sets the hopper 6 at a position farthest from the paper feed roller 3, after the end of feeding of one printing sheet P, but executes the small release mode after the feeding operation of the printing sheet P. As a result, the uppermost printing sheet P is slightly separated from the paper feed roller 3. And, in feeding the next printing sheet P, the hopper 6 is able to abut the printing sheet P against the paper feed roller 3 by its slight turn.

Figure 22A:
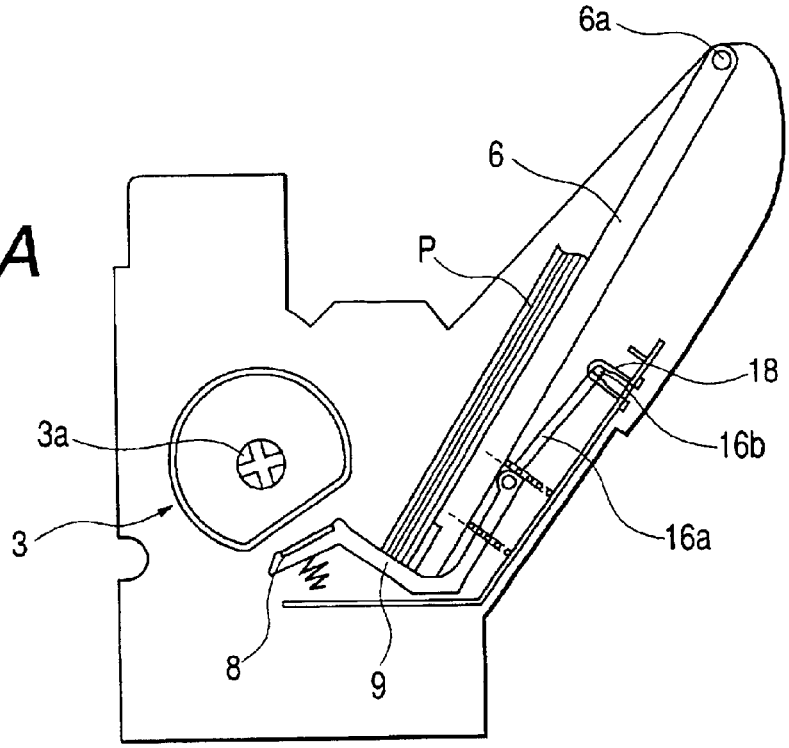
FIGS. 22A and 22B are diagrams for explaining states of the paper feeder during the paper feeding operation of the paper feeder of the invention.
Figure 22B:
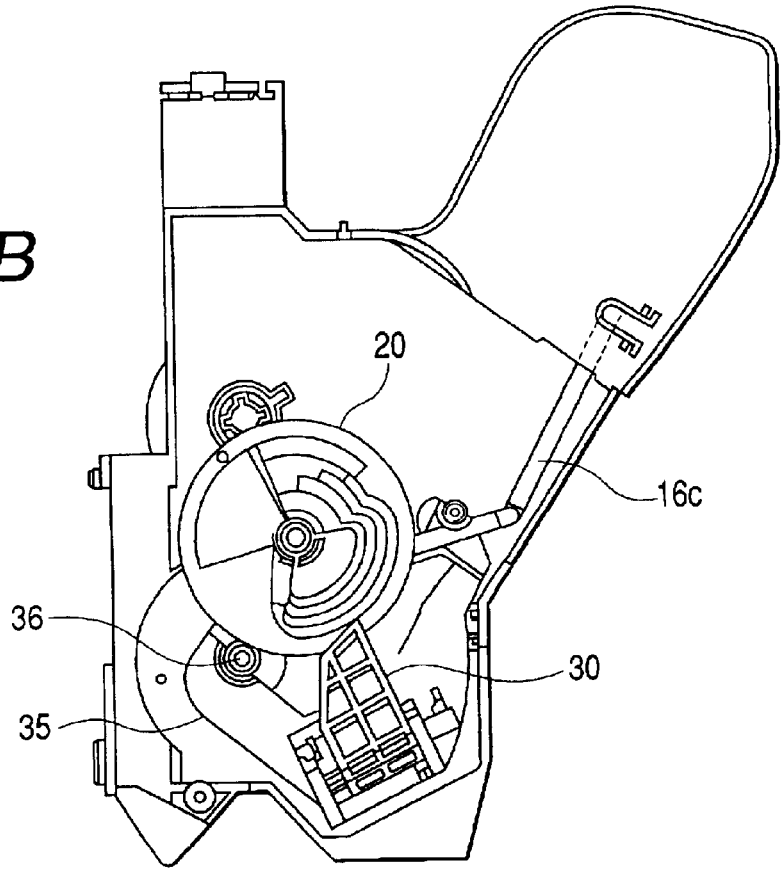

When the printing operation completely ends, and a paper feeding job for the subsequent printing sheets P is not present, the hopper release device executes the large release mode and enters a rest mode. More exactly, after the segment "e" in FIG. 14 terminates (the printing operation ends), the hopper release device enters a control phase of a segment "f". In the segment "f", the paper feed roller 3 is normally rotated; the cam lever 30 is moved out of the fan-shaped cam 22*c*, and it is guided to the non-cam part 26 (FIG. 20B); the paper feed roller 3 is reversely rotated from its state; the cam lever 30 is guided to the outer periphery surface of the fan-shaped cam 22*a* (FIG. 21B); and the hopper 6 is turned to a position farthest from the paper feed roller 3. That is, the hopper release device executes the large release mode (FIGS. 22A and 22B).

In this instance, by normally rotating the paper feed roller 3, the cam lever 30 is moved out of the fan-shaped cam 22*c* and guided to the non-cam part 26. However, the cam lever may be guided to the non-cam part 26 by reversely rotating the paper feed roller 3 (the rotary cam 20 is turned clockwise in the figure). In this case, by rotating the paper feed roller 3 in the reverse direction from a state that the cam lever 30 is put on the fan-shaped cam 22*c*, the large release mode may be executed.

As described above, the hopper release device executes the small release mode when a paper feeding job for feeding the next printing sheet P and the subsequent ones is left after the feeding of the uppermost printing sheet P ends. Therefore, a swing range (swing angle) of the hopper 6 when the next or second printing sheet P is fed is minimized. As a result, noise generated when the hopper 6 is swung is reduced, and the high speed paper feeding operation (repetitive paper feeding operation) can be performed.

The hopper 6 is turned in such a direction as to be pressed against the paper feed roller 3 by the compression coiled spring 7. The turning of the hopper is performed through the release bar 16 being restrained by the cam lever holder 35. Accordingly, there is no chance that the printing sheets P stacked on the hopper 6 energetically hit the paper feed roller 3 by the urging force of the compression coiled spring 7. As a result, problems including unevenness and wrinkles of the printing sheet P are not created.

Returning to FIG. 7, the tips of the printing sheets P stacked on the hopper 6 slide on the guide surfaces 13*a* of the guide member 13 when the hopper 6 swings. Therefore, if the friction coefficient between the guide surfaces 13*a* and the tips of the printing sheets P is large, it is impossible to smoothly feed the printing sheets even if the swing range (swing angle) of the hopper 6 is reduced as described above. For this reason, the guide surfaces 13*a* in the instant embodiment are coated with lubricant to reduce its friction coefficient ($\mu$<0.3 in the embodiment), thereby ensuring a smooth paper feeding operation. In the embodiment, a control as given below is applied to a sequence of paper feeding operations, whereby the problems in the paper feeding operation are solved and normal print quality is more reliably secured.

In FIG. 7, the printing sheet P fed from the paper feed roller 3 passes the detector 136*a* of the sheet detector 136 and is nipped between the transport drive roller 162 and the transport follower roller 163. After it is nipped between the two rollers, a fixed quantity initial setting control is carried out and operation of printing on the printing sheet P starts. The fixed quantity initial setting control is sometimes carried out in such a manner that the sheet detector 136 outputs a detect signal indicative of passage of the tip of printing sheet P, and the transport drive roller 162 is rotated by a predetermined phase at the timing of receiving the detect signal.

FIG. 14 shows relationships among a timing at which the sheet detector 136 detects the passage of the tip of the printing sheet P, a timing at which the printing sheet P tip reaches a nip point between the transport drive roller 162 and the transport follower roller 163, and a state of the hopper 6. At a point I the printing sheet P tip passes the detector 136*a* of the sheet detector 136, and at a point II the tip reaches the nip point between the transport drive roller 162 and the transport follower roller 163.

However, if the swing operation of the hopper 6 is not smoothly performed and a timing at which the uppermost printing sheet P is pressed against the paper feed roller 3, retards, there is a possibility that the points I and II shift to points I' and II', respectively, as shown in FIG. 4. Then, there is a possibility that a point at which the hopper 6 is switched from a non-release state to a small release state is contained between the points I' and II', viz., the small release mode is executed.

When the hopper 6 executes the small release mode, the cam lever 30 climbs from a small diameter cam part 23 to a large diameter cam part 22 as described above. Accordingly, a rotation load is imparted to the paper feed roller shaft 3*a* as a rotation shaft of the rotary cam 20. As a result, a twist is generated in the paper feed roller shaft 3*a*. When the paper feed roller shaft 3*a* is twisted, the quantity of feeding of the printing sheet P reduces correspondingly.

In a case where as described above, the initial setting quantity of the printing sheet P measured from the nip point between the transport drive roller 162 and the transport follower roller 163 is controlled using a timing at which a detect signal indicative of passage of the leading edge of the printing sheet P is received from the sheet detector 136, when a timing at which the uppermost printing sheet P is abutted on the paper feed roller 3 retards, and the quantity of feeding of the printing sheet P is reduced by the twist of the paper feed roller shaft 3*a* between the points I' and II' as described above, a timing at which the leading edge of the printing sheet P reaches the nip point between the transport drive roller 162 and the transport follower roller 163 retards, and as a result, an intended initial setting quantity is not obtained sometimes. This is particularly problematic because the hopper 6 is in a large release state (the paper feed unit 1 is in a rest state) and by executing the non-release mode from the large release state, the uppermost printing sheet P is abutted on the paper feed roller, and at the first printing sheet P when a series of rest jobs are executed, the swing angle of the hopper 6 is maximized.

The insufficient initial setting problem may be solved in a manner that at the start of executing a series of paper feeding jobs, only the first printing sheet is subjected to the skew removal of, for example, the called biting/releasing type (in which the leading edge of the printing sheet P is bit between the transport drive roller 162 and the transport follower roller 163, and then is released and discharged upstream). The problem may also be solved in a manner that the urging force of the urging device of the hopper 6 (compression coiled spring 7 in the embodiment) is increased to be large to ensure a reliable rotation of the hopper 6 in such a direction as to be abutted against the paper feed roller 3.

Second Embodiment

Figure 23:
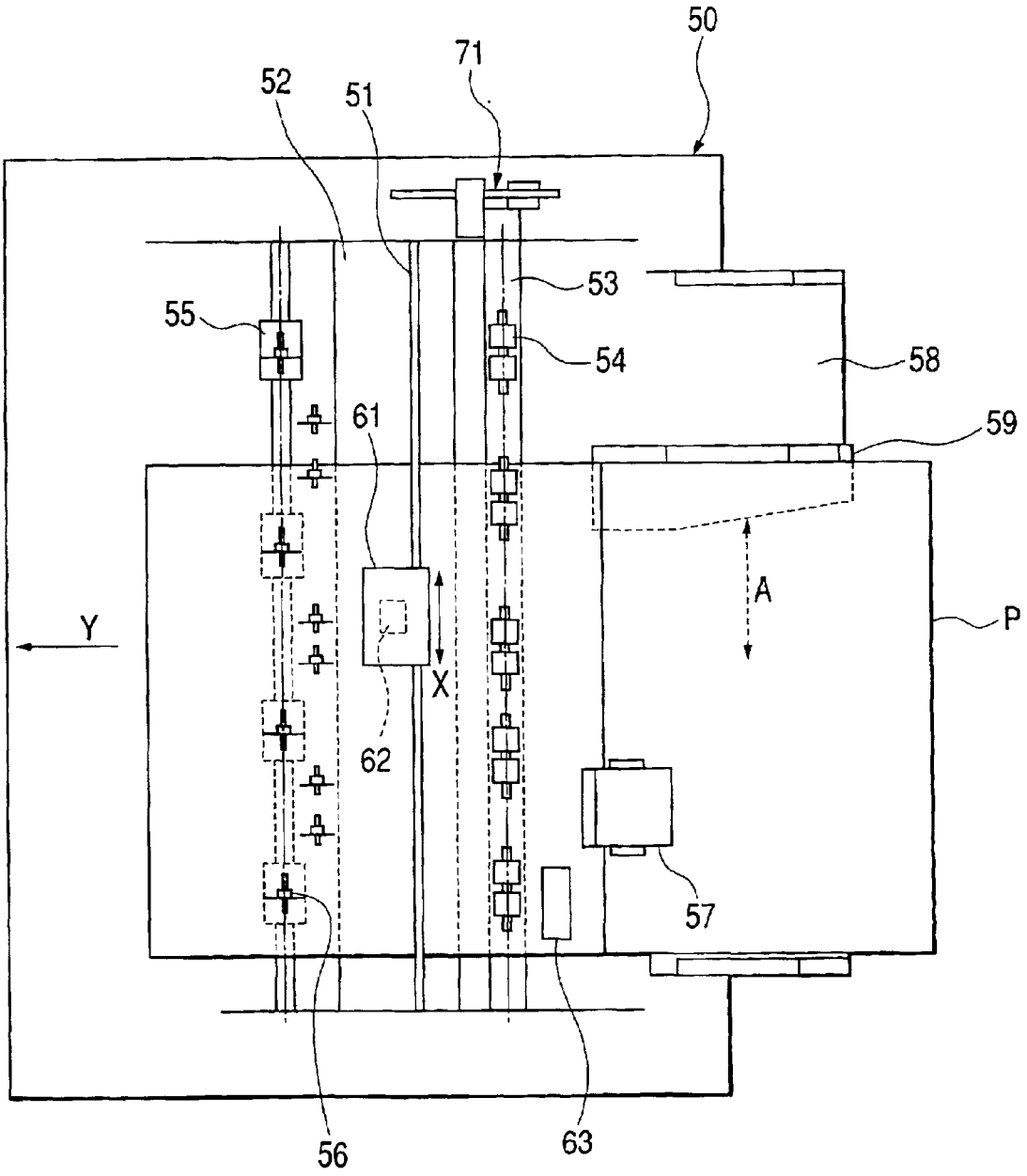
FIG. 23 is a plan view schematically showing a second embodiment of an ink jet printer according to the present invention.
Figure 24:
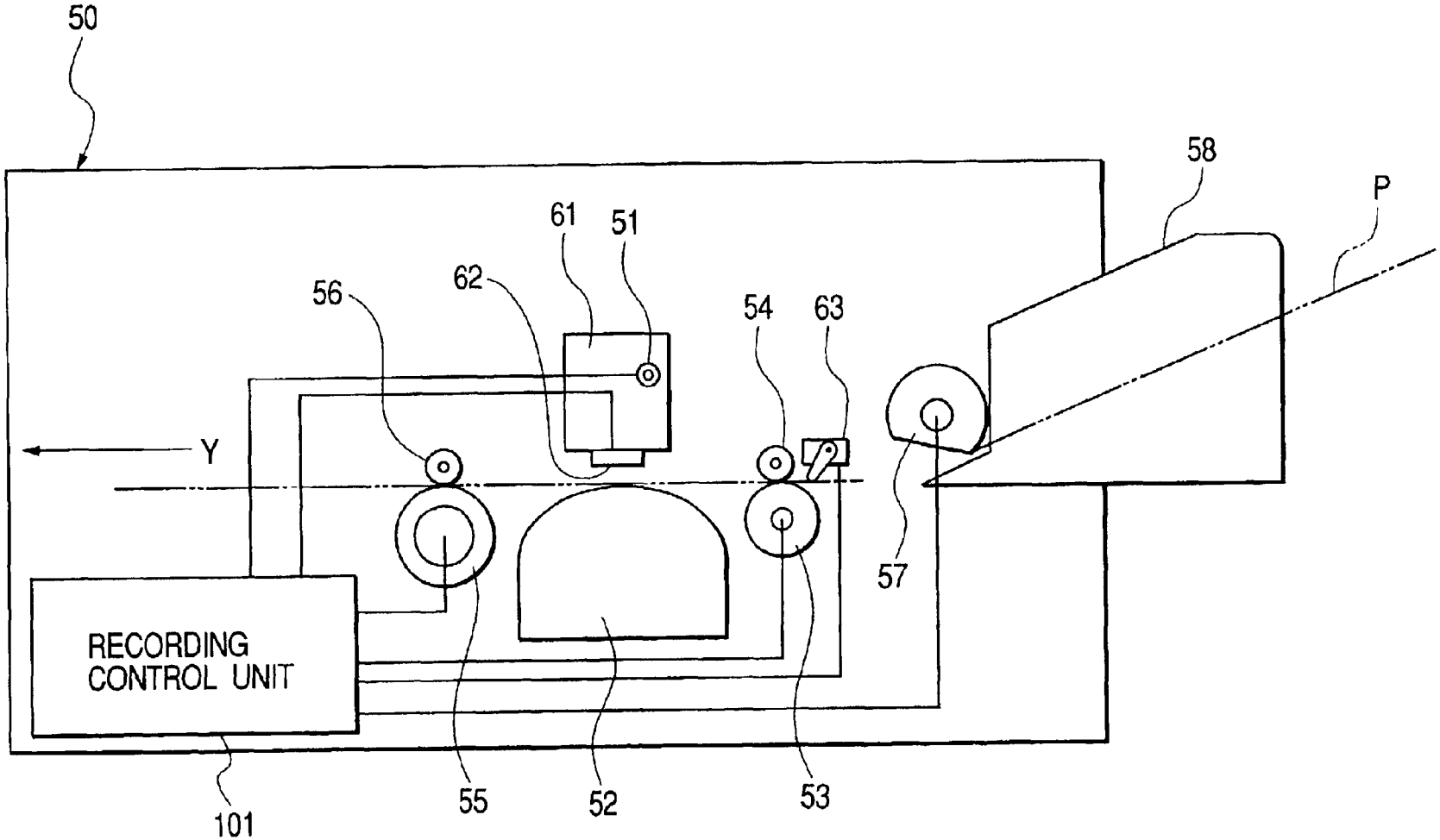
FIG. 24 is a side view schematically showing a second embodiment of an ink jet printer according to the present invention.

FIG. 23 is a plan view schematically showing a second embodiment of an ink jet printer according to the invention of the present patent application. FIG. 24 is a side view of the same. In an ink jet printer 50 of the second embodiment, a carriage 61 which is axially supported by a carriage guide shaft 51 and moved in the main scan direction X is used for a recording execution device for recording on a paper sheet P, such as a plain paper or photo paper. A recording head 62 for ejecting ink to the printing sheet P for recording is mounted on the carriage 61. A platen 52 for defining a gap between the head surface of the recording head 62 and the printing sheet P is provided in opposition to the recording head 62. An image is recorded on the printing sheet P in a manner that the carriage 61 is moved in the main scan direction X while the printing sheet P is moved in the sub-scan direction between the carriage 61 and the platen 52, and in this state the recording head 62 ejects ink onto the printing sheet P.

A paper feed tray 58 is constructed so as to feed printing sheets P. An auto paper feeder (ASF) for automatically feeding printing sheets P stacked in the paper feed tray 58 sheet by sheet is provided. The ASF is a paper feeder mechanism including a paper feed roller 57 provided on the paper feed tray 58 and a separation pad (not shown). The paper feed roller 57 is controlled by a rotational drive force output from a stepping motor or the like, and is shaped like D in cross section. The paper feed roller 57 is disposed closer to one side of the paper feed tray 58. A printing sheet guide is provided on the paper feed tray 58. The printing sheet guide has the width corresponding to the width of the printing sheet P and is slidable in an arrow direction A.

A rotational drive force of the paper feed roller 57 and frictional resistance of the separation pad cooperate to enable a plurality of printing sheets P stacked on the paper feed tray 58 to be fed exactly sheet by sheet, without simultaneous feeding of a plurality of printing sheets P. The printing sheet P as fed is intermittently transported by a given paper feed quantity toward a downstream side as a recording-execution region in the sub-scan direction Y, by means of a printing sheet transporting device disposed downstream of the paper feed roller in the sub-scan direction.

A transport drive roller 53 and a transport follower roller 54 are provided for printing sheet transport device for intermittently transporting the printing sheet P in the sub-scan direction Y. The transport drive roller 53 is rotated by a rotational drive force of a stepping motor or the like, and a rotational force of the transport drive roller 53 transports the printing sheet P in the sub-scan direction Y. A plurality of transport follower rollers 54 are provided and are driven by the transport drive roller 53. When the printing sheet P is transported with the rotation of the transport drive roller 53, the transport follower rollers come in contact with the printing sheet P, and are rotated following the transporting of the printing sheet P.

An encoder device 71 for detecting a rotational displacement quantity of the transport drive roller 53 is disposed near one end of the transport drive roller 53. The transport drive roller 53 is controlled to rotate by a predetermined amount of rotation in accordance with a rotational displacement quantity of the transport drive roller 53 detected by the encoder device 71, whereby the printing sheet P is transported by a predetermined transport amount.

A sheet detector 63 is disposed between the paper feed roller 57 and the transport drive roller 53. The sheet detector 63 includes a rotatable lever part. When the lever part is pushed by the printing sheet P, the lever part is turned, and the printing sheet P is detected in a state that it is abutted on the printing sheet P.

A sheet-discharge drive roller 55 and a sheet-discharge follower roller 56 are provided for a device for discharging a recorded printing sheet P. The sheet-discharge drive roller 55 is rotated by a rotational drive force of a stepping motor or the like, and with rotation of the sheet-discharge drive roller 55, the printing sheet P is discharged in the sub-scan direction Y. A plurality of sheet-discharge follower rollers 56 are provided. Each sheet-discharge follower roller 56 has teeth formed around the periphery. The tip of each tooth is acute in shape so that it comes in point contact with the recording surface. Thus, each sheet-discharge follower roller 56 is a roller equipped with teeth. Those transport follower rollers are driven by a driving force, which is weaker than a drive force of the transport follower roller 54 by the sheet-discharge drive roller 55. When the printing sheet P is discharged with rotation of the sheet-discharge drive roller 55, those follower rollers come in contact with the printing sheet P and are rotated following the rotation of the printing sheet P.

Further, the ink jet printer 50 includes a recording control unit 101. The recording control unit 101 includes a CPU (central processing unit), and periphery units such as ROM and RAM. It executes a control program for the ink jet printer 50, such as a recording execution control, and controls the ink jet printer 50.

Figure 25:
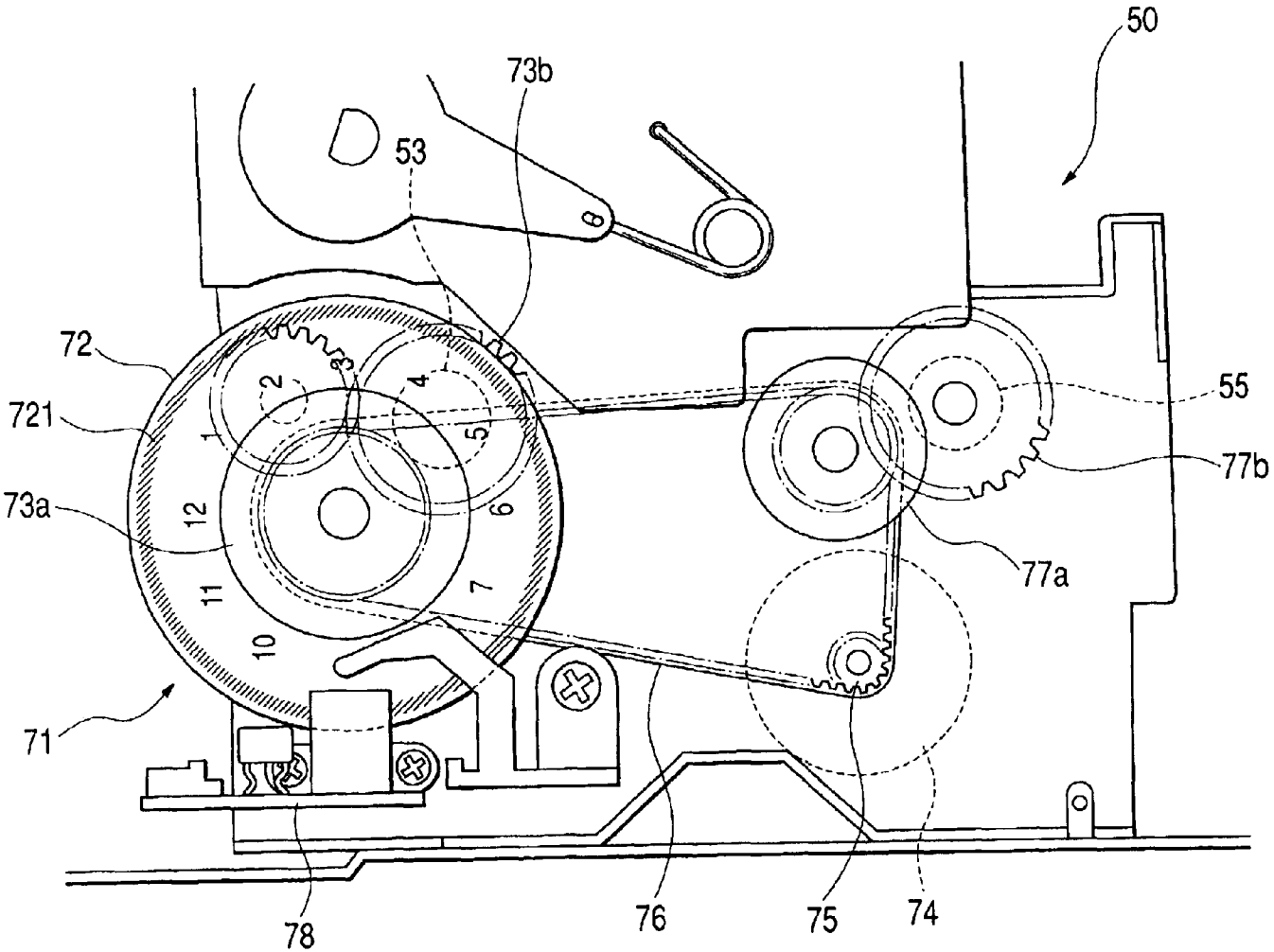
FIG. 25 is a side view schematically showing a second embodiment of an ink jet printer according to the present invention, in particular, an encoder and its vicinal structure.

FIG. 25 is a side view showing a key portion of an ink jet printer 50 of the present embodiment, in particular, a structure including an encoder 71 and its vicinal structure.

In the encoder device 71, a rotary member 72 is fastened to a gear 73*a*. A plurality of slits 721 are formed in the rotary member 72 and are equiangularly disposed. The slits 721 are simply illustrated in the form of an area of slanted lines. The gear 73*a* is rotatably supported on the main body of the ink jet printer 50. A gear 73*b* is mounted on the transport drive roller 53 (FIG. 24) in a rotation transmission manner, and is in mesh with the gear 73*a*. The gear 73*a* is coupled through an endless belt 76 to a pulley 75 of a printing sheet transport gear 74 in a drive force transmission manner. A rotation drive force of the printing sheet transport gear 74 is transmitted to the transport drive roller 53 by way of the gear 73*b* being in mesh with the gear 73*a*. The transport drive roller 53 is rotated by a rotation transmission force of the printing sheet transport gear 74.

In the embodiment, a gear 77*a* is also coupled with the printing sheet transport gear 74 by way of the endless belt 76 in a drive force transmission manner. The gear 77*a* is rotatably supported on the main body of the ink jet printer 50. A gear 77*b* is coupled to the sheet-discharge drive roller 55 (FIG. 24) in a rotation transmission manner, and is in mesh with the gear 77*a*. A rotation drive force of the printing sheet transport gear 74 is transmitted to the sheet-discharge drive roller 55 by way of the gear 77*b* engaging with the gear 77*a*. The sheet-discharge drive roller 55 is rotated by a rotation drive force of the printing sheet transport gear 74.

A detector 78 for detecting the slits 721 formed in the rotary member 72 is disposed in the rotation area of the rotary member 72, as shown. The detector 78 discriminates between an intercepting part and a light transmission part, which are defined by the slits 721, detects the slits 721, and detects a rotational displacement quantity of the gear 73*a* coupled to the rotation shaft of the transport drive roller 53. The recording control unit 101 (FIG. 24) computes a rotational displacement quantity of the transport drive roller 53, which is coupled thereto via the gear 73*b*, from the rotational displacement quantity of the gear 73*a*, and controls the rotation of the transport drive roller 53 in accordance with the computed rotational displacement quantity.

Figure 26:
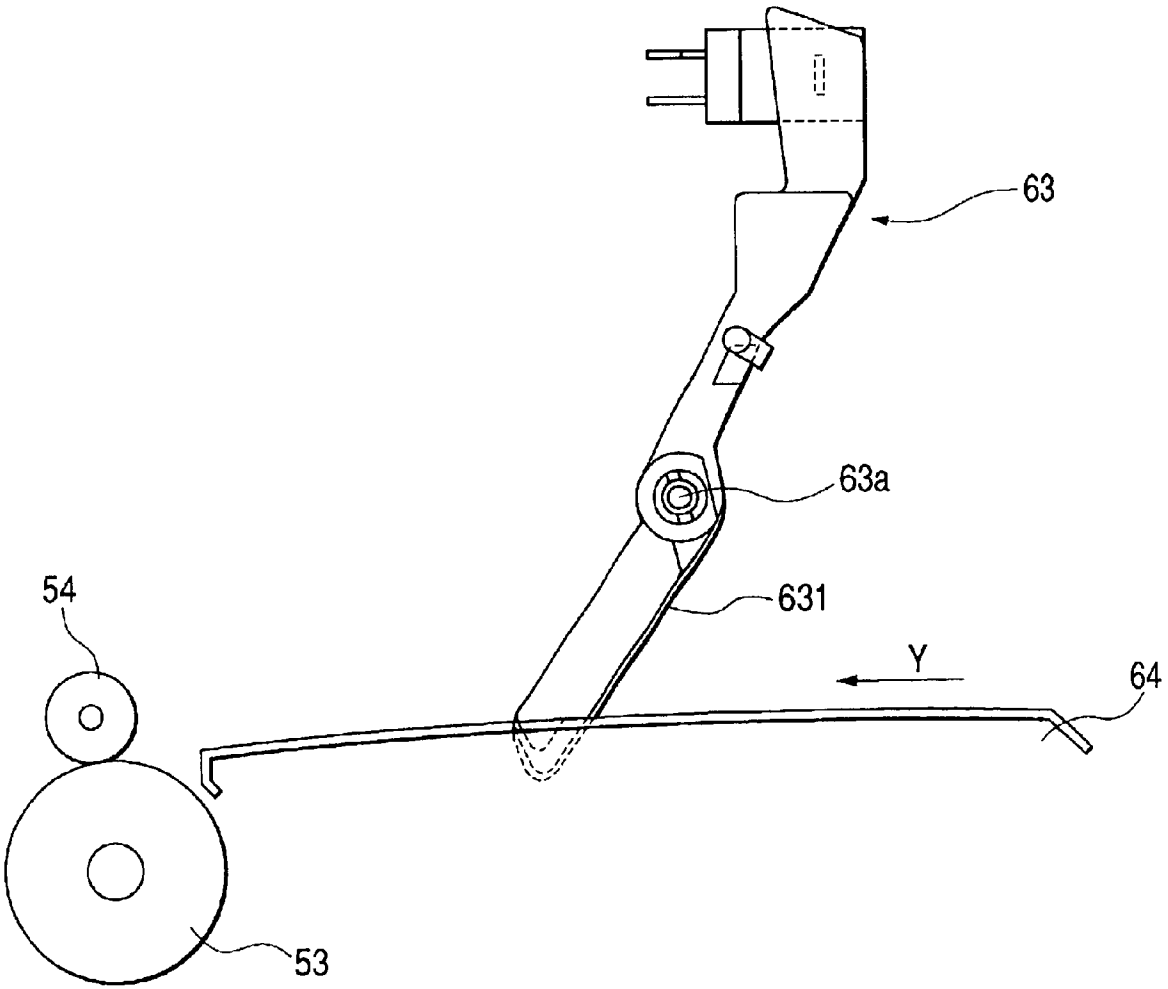
FIG. 26 is a side view schematically showing a key portion of a second embodiment of an ink jet printer according to the present invention.

FIG. 26 is a side view showing a key portion of the ink jet printer 50 of the instant embodiment.

The sheet detector 63 includes a lever 631 which is granted with self-resetting habit for standing attitude, and pivotally supported to be rotatable around a fulcrum of a support part 63*a* only in the sub-scan direction Y in a state that it is protruded into a sheet transport path of the printing sheet P. When the tip of the carriage 61 is pushed with the printing sheet P, the lever 631 is turned around the support part 63*a* and the printing sheet P is detected. With rotation of the lever 631, an electrical contact (not shown) of the sheet detector 63 is turned on and off, and the on/off information is input to the recording control unit 101. Upon receipt of the on/off information derived from the electrical contact of the sheet detector 63, the recording control unit 101 detects the leading position and the terminal position of the printing sheet P.

Figure 27:
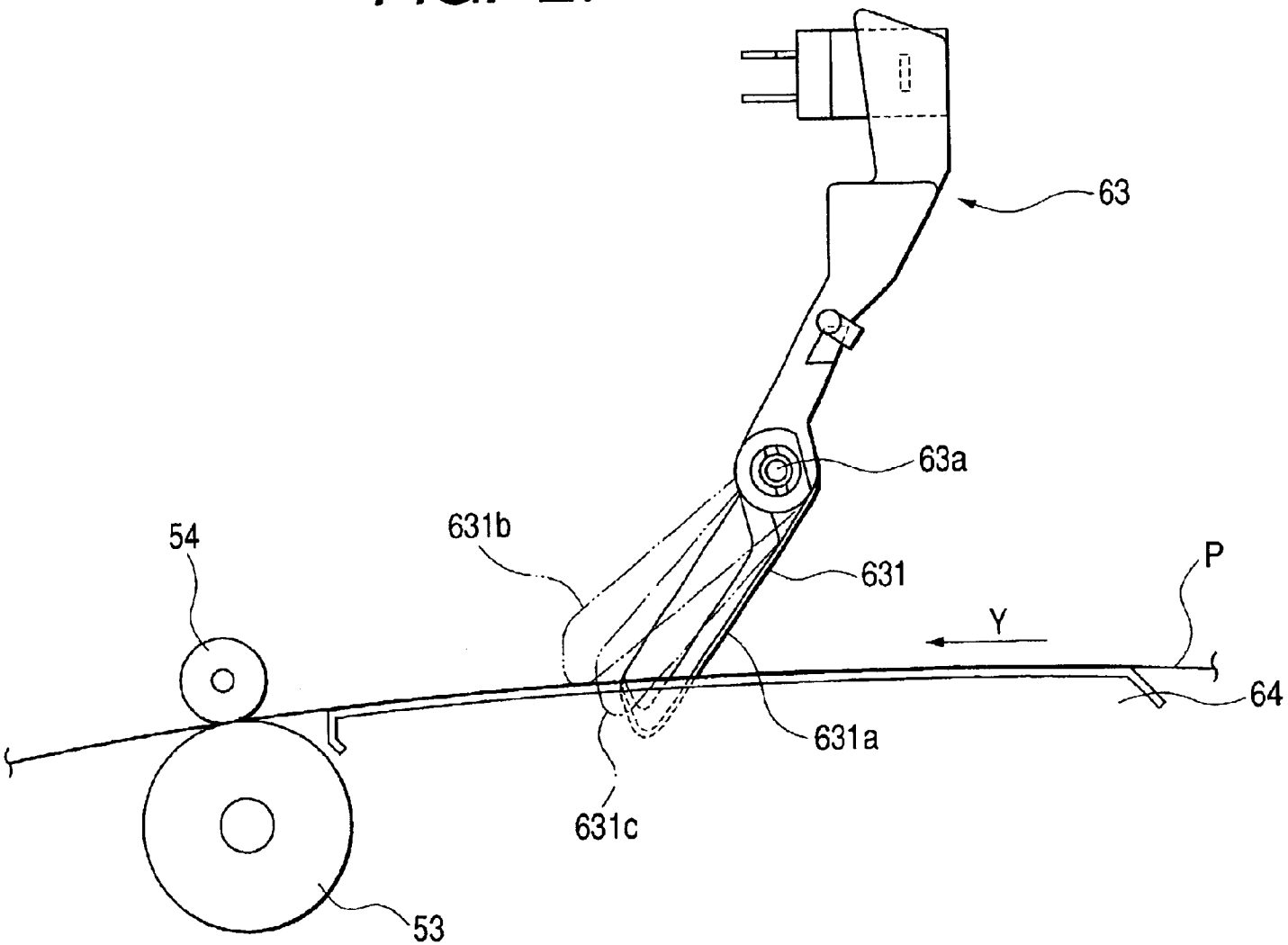
FIG. 27 is a side view showing a sheet detector mounted on the ink jet printer of the second embodiment.

FIG. 27 is a side view showing the sheet detector 63 mounted on the ink jet printer 50, and a state that the lever 631 is pushed with the printing sheet P to be turned.

When the printing sheet P is not transported along a sheet transport path 64, the lever 631 is at a rotational position, in a normal state indicated by reference numeral 631*a*. At this rotational position, an electric contact of the sheet detector 63 is in an off state. During the transportation of the printing sheet P along the sheet transport path 64, the lever 631 of the sheet detector 63 is pushed with the printing sheet P to be turned to a position of a contour line indicated by a chain line 631*b*. Accordingly, at the rotational position of the lever 631, the electrical contact is in an on state. A rotational position of the lever 631 indicated by a contour line of a chain line 631*c*, which is a mid position between a rotational position, designated by 631*a*, of the lever 631 and a rotational position, designated by 631*b*, of the lever 631, is a rotational position of the lever 631 at which the electrical contact changes its state from an on state to an off state and vice versa.

At the instant that the terminal edge of the printing sheet P having turned the lever 631 to the rotational position indicated by numeral 631*b*, leaves the lever 631, the electrical contact of the sheet detector 63 is still in an on state. When the lever 631 starts to turn by its self-resetting habit for standing attitude and reaches a rotational position indicated by numeral 631*c*, the electrical contact changes its state from the on state to the off state. At this time point, it is detected that the terminal edge of the printing sheet P passes the sheet detector 63.

A time taken from an instant that the terminal edge of the printing sheet P leaves the lever 631 till it is turned from the rotational position 631*b* to the rotational position 631*c*, is a detect delay time when the terminal edge of the printing sheet P is detected. A quantity of the transportation of the printing sheet P which is performed during the detect delay time is a detect delay error transportation quantity.

The detect delay error transportation quantity is given by the following equation (1)

$$Y=kx \tag{1}$$

where x: transporting speed of the printing sheet P at a time point that it is detected that the terminal edge of the printing sheet P passes the sheet detector 63, y: detect delay error transportation quantity k: delay coefficient The delay coefficient "k" varies depending on a detecting characteristic of the sheet detector 63 and a relation between the position at which the sheet detector 63 is disposed and the sheet transport path 64. The delay coefficient "k" is a known value determined every specification of the ink jet printer 50.

Thus, the detect delay error transportation quantity "y" increases proportional to the transporting speed "x" of the printing sheet P. Accordingly, the detect delay error transportation quantity "y" can be obtained by multiplying the transporting speed "x" by a fixed delay coefficient "k".

Figure 28:
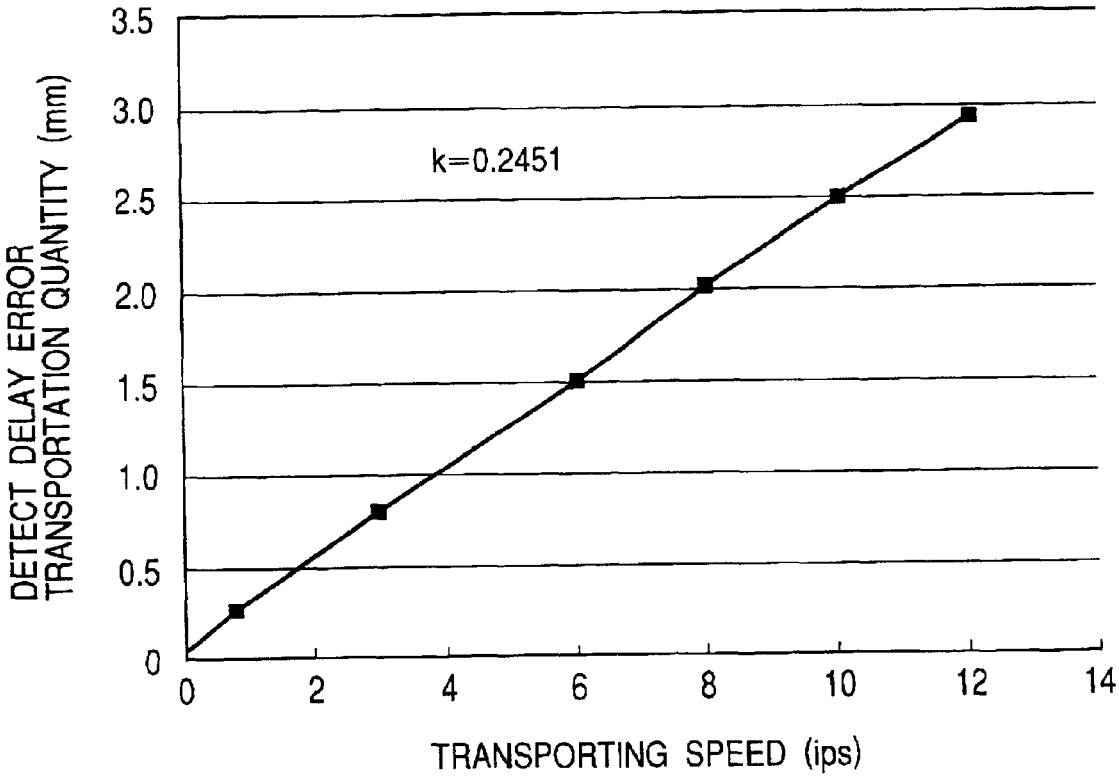
FIG. 28 is a graph showing a relationship between a transporting speed of the printing sheet and a detect delay error transportation quantity.

FIG. 28 is a graph showing a relationship between a transporting speed "x" of the printing sheet P and a detect delay error transportation quantity "y".

Since the detect delay error transportation quantity "y" is proportional to the transporting speed "x", its variation may be depicted as a line linearly varying upward as shown. The detect delay coefficient "k" indicates a gradation of the linear line in the graph. In the embodiment, the detect delay coefficient "k" is 0.2451.

As seen also from the graph, the transporting speed "x" is 12 ips, the detect delay error transportation quantity "y" caused at considerably high speed is about 3 mm, and a detect offset of the terminal edge of the printing sheet P is about 3 mm. Therefore, the terminal edge position of the printing sheet P can exactly be detected if the terminal edge position of the printing sheet P as detected by the sheet detector 63 is corrected by a quantity corresponding to the detect delay error transportation quantity "y".

FIG. 29 is a table showing a relationship among a transporting speed of a printing sheet P at a time point where the sheet detector 63 detects the terminal edge of the printing sheet P, an encoder period detected by an encoder device 71, and a correction quantity of the terminal edge position of the printing sheet P.

In the figure, an encoder period (μs) is computed using an encoder signal output from the sheet detector 63, and a transporting speed (ips) is computed using the computed encoder period. The computed transporting speed is rounded off in the unit of 1.5 ips. A detect delay error transportation quantity caused when the terminal edge of the printing sheet P passes the sheet detector 63 at the transporting speed in the unit of 1.5 ips, is expressed by a correction quantity (mm) corresponding to a detect offset of the terminal edge of the printing sheet P and a number of pulses (1/1440 dpi) of an encoder signal corresponding to the correction quantity of distance.

From the encoder period (μs) at a time point at which the sheet detector 63 detects passage of the terminal edge of the printing sheet P, the transporting speed (ips) of the printing sheet P at that time is calculated. A correction quantity for the transporting speed is computed by using the equation (1). The number of pulses of the encoder signal corresponding to the computed correction quantity (mm) are added to a transportation quantity of the printing sheet P stored in the recording control unit 101. In this way, the offset of the terminal edge of the printing sheet P as detected by the sheet detector 63 can be corrected exactly. The recording control unit 101 stores the table shown in FIG. 29, for example, as a data table. At a time point that the terminal edge of the printing sheet P passes the sheet detector 63, viz., the electrical contact of the sheet detector 63 is put to an off state, it computes an encoder period from the encoder signal output from the encoder device 71, and adds the computed one to a transportation quantity of the printing sheet P as a count of the number of pulses (1/1440 dpi) corresponding to the correction quantity (mm) corresponding to the encoder period (μs). By so doing, it can obtain a necessary correction quantity of the terminal edge of the printing sheet P.

In the ink jet printer 50 which is presented as the embodiment of the invention of the present patent application, a correction quantity is computed from a transporting speed of the printing sheet P at a time point that the sheet detector 63 detects passage of the terminal edge of the printing sheet P, and the terminal edge position of the printing sheet P is corrected based on the computed one. Therefore, even when the printing sheet P is transported at high speed and its recording operation is performed, there is less chance that the terminal edge position of the printing sheet P is greatly shifted, and the recording quality is deteriorated.

Although the invention has been described in its preferred form with a certain degree of particularity, obviously many changes and variations are possible therein. It is therefore to be understood that the present invention may be practiced than as specifically described herein without departing from the scope and the spirit thereof.

What is claimed is:

1. A paper feeder comprising;

a paper feed roller for feeding a recording material to a downstream side of transportation by the paper feed roller;

a hopper formed with a plate member long in a width direction of the recording material, the hopper being angularly moved around a fulcrum thereof so as to be apart from and to be abutted against the paper feed roller;

an urging device located opposite to the paper feed roller with respect to the hopper for urging the hopper toward the paper feed roller from a backside of the hopper; and a hopper release device for moving the hopper apart from the paper feed roller while resisting the urging device;

wherein a plurality of the recording materials are stacked in the hopper and are pushed upward so as to be successively fed to the downstream side of transportation from an uppermost recording material of the stacked recording materials; and the hopper release device has a non-release mode where the uppermost recording material is abutted against the paper feed roller by an urging force of the urging device, a small release mode where the hopper is turned and held so that the uppermost recording material is slightly separated from the paper feed roller, and a large release mode where the hopper is turned and held so that the hopper is at the most apart from the paper feed roller.

2. A paper feeder according to claim 1, wherein the hopper release device is brought in the small release mode during a period between an end of feeding the uppermost recording material and a start of feeding the successive recording material.

3. A paper feeder according to claim 1, wherein the hopper release device is brought in the large release mode after an end of feeding a final recording material.

4. A paper feeder according to claim 1, wherein the hopper release device includes a rotary cam that is configured such that a rotational position of the rotary cam dictates whether the hopper release device is in the non-release mode, the small release mode or the large release mode.

5. A recording apparatus for recording an image on a recording material, comprising a paper feeder provided with:

a paper feed roller for feeding a recording material to a downstream side of transportation by the paper feed roller;

a hopper formed with a plate member long in a width direction of the recording material, the hopper being angularly moved around a fulcrum thereof so as to be apart from and to be abutted against the paper feed roller;

an urging device located opposite to the paper feed roller with respect to the hopper for urging the hopper toward the paper feed roller from a backside of the hopper; and a hopper release device for moving the hopper apart from the paper feed roller while resisting the urging device;

wherein a plurality of the recording materials are stacked in the hopper and are pushed upward so as to be successively fed to the downstream side of transportation from an uppermost recording material of the stacked recording materials; and the hopper release device has a non-release mode where the uppermost recording material is abutted against the paper feed roller by an urging force of the urging device, a small release mode where the hopper is turned and held so that the uppermost recording material is slightly separated from the paper feed roller, and a large release mode where the hopper is turned and held so that the hopper is at the most apart from the paper feed roller.

6. A recording apparatus according to claim 5, wherein the hopper release device includes a rotary cam that is configured such that a rotational position of the rotary cam dictates whether the hopper release device is in the non-release mode, the small release mode or the large release mode.

7. A paper feeder comprising:

a paper feed roller for feeding a recording material to a downstream side of transportation by the paper feed roller;

a hopper formed with a plate member long in a width direction of the recording material, the hopper being angularly moved around a fulcrum thereof so as to be apart from and to be abutted against the paper feed roller;

means for urging the hopper toward the paper feed roller from a backside of the hopper; and means for moving the hopper apart from the paper feed roller while resisting the means for urging;

wherein a plurality of the recording materials are stacked in the hopper and are pushed upward so as to be successively fed to the downstream side of transportation from an uppermost recording material of the stacked recording materials; and wherein the means for moving the hopper has a non-release mode where the uppermost recording material is abutted against the paper feed roller by an urging force of the means for urging, a small release mode where the hopper is turned and held so that the uppermost recording material is slightly separated from the paper feed roller, and a large release mode where the hopper is turned and held so that the hopper is at the most apart from the paper feed roller.

8. A paper feeder according to claim 7, wherein the means for moving the hopper is brought into the small release mode during a period between an end of feeding the uppermost recording material and a start of feeding the successive recording material.

9. A paper feeder according to claim 7, wherein the means for moving the hopper is brought into the large release mode after an end of feeding a final recording material.

10. A paper feeder according to claim 7, wherein the means for moving the hopper includes a rotary cam that is configured such that a rotational position of the rotary cam dictates whether the means for moving the hopper is in the non-release mode, the small release mode or the large release mode.

* * * * *